US008668192B2

(12) United States Patent
Matsushita et al.

(10) Patent No.: US 8,668,192 B2
(45) Date of Patent: Mar. 11, 2014

(54) INSERTION SYSTEM, IMAGE FORMING SYSTEM, AND INSERTION METHOD

(75) Inventors: Shingo Matsushita, Tokyo (JP); Ikuhisa Okamoto, Kanagawa (JP); Takeshi Sasaki, Kanagawa (JP); Satoshi Saito, Kanagawa (JP); Akira Kunieda, Tokyo (JP); Takahiro Watanabe, Kanagawa (JP); Jun Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/493,397

(22) Filed: Jun. 11, 2012

(65) Prior Publication Data

US 2012/0322641 A1 Dec. 20, 2012

(30) Foreign Application Priority Data

Jun. 20, 2011 (JP) ..... 2011-136612

(51) Int. Cl.
*B43M 3/02* (2006.01)

(52) U.S. Cl.
USPC ..... 270/58.06; 270/32; 270/45; 270/58.07

(58) Field of Classification Search
USPC ..... 270/32, 45, 58.06, 58.07; 493/405
See application file for complete search history.

(56) References Cited

U.S. PATENT DOCUMENTS

| | | | | |
|---|---|---|---|---|
| 4,995,600 | A * | 2/1991 | Kovac et al. | 270/45 |
| 5,234,399 | A * | 8/1993 | Boughton et al. | 493/420 |
| 5,702,097 | A * | 12/1997 | Bakoledis | 270/58.06 |
| 5,819,666 | A * | 10/1998 | Ishikawa et al. | 101/483 |
| 2009/0252545 | A1 | 10/2009 | Sasaki | |
| 2009/0257846 | A1 | 10/2009 | Matsushita et al. | |
| 2009/0263212 | A1 | 10/2009 | Sasaki et al. | |
| 2009/0269167 | A1 | 10/2009 | Iida et al. | |
| 2010/0226733 | A1 | 9/2010 | Ilda et al. | |
| 2010/0239391 | A1 | 9/2010 | Sasaki et al. | |
| 2010/0329821 | A1 | 12/2010 | Sasaki et al. | |
| 2011/0184889 | A1 | 7/2011 | Tokita et al. | |
| 2011/0220557 | A1 | 9/2011 | Sasaki et al. | |
| 2011/0277418 | A1 | 11/2011 | Kunieda et al. | |
| 2012/0131885 | A1 | 5/2012 | Matsushita et al. | |

FOREIGN PATENT DOCUMENTS

| | | | |
|---|---|---|---|
| JP | 05032231 | A | 2/1993 |
| JP | 2000-301892 | A | 10/2000 |
| JP | 2003-002527 | A | 1/2003 |
| JP | 2004-045650 | A | 2/2004 |

* cited by examiner

*Primary Examiner* — Leslie A Nicholson, III
(74) *Attorney, Agent, or Firm* — Harness, Dickey & Pierce, P.L.C.

(57) ABSTRACT

An insertion system includes a folding device to perform either single-sheet folding to fold a single sheet at a time or batch folding to fold multiple sheets together at a time, an insertion device to insert into an envelope the sheet folded by the folding device, and a batch setting unit to designate either the single-sheet folding or the batch folding from a folding and insertion menu for multiple sheets at a time when the multiple sheets are processed by the folding device and the insertion device.

10 Claims, 25 Drawing Sheets

INSERTION SYSTEM, IMAGE FORMING SYSTEM, AND INSERTION METHOD

CROSS-REFERENCE TO RELATED APPLICATIONS

This patent application is based on and claims priority pursuant to 35 U.S.C. §119 to Japanese Patent Application No. 2011-136612, filed on Jun. 20, 2011, in the Japan Patent Office, the entire disclosure of which is hereby incorporated herein by reference.

FIELD OF THE INVENTION

The present invention generally relates to an insertion system that inserts sheets into envelopes, an image forming system including an image forming apparatus to form an image on a sheet and an insertion device to insert the sheet into an envelope, and a method for inserting sheets into envelopes.

BACKGROUND OF THE INVENTION

Independent insertion devices controlled off-line from image forming apparatuses and capable of inserting into respective envelopes a large amount of enclosures on which images are formed by the image forming apparatuses (hereinafter "enclosures") are known.

However, in such insertion systems in which the insertion device is controlled off-line from the image forming apparatus, time efficiency is low, in particular in small-lot insertion processing, because image formation on enclosures and insertion of the enclosures into envelopes are performed by separate devices. Therefore, connecting the image forming apparatus to the insertion device is preferred to enable online insertion, thereby reducing loss in time.

Additionally, there are insertion systems that include a folding device to fold enclosures to be inserted into envelopes. However, known inline insertion systems do not offer inserting a sheet folded in single-sheet folding together with sheets folded in batch folding in an identical envelope together at a time. It is to be noted that the terms "single-sheet folding" and "batch folding" used in this specification mean folding a single sheet at a time and folding multiple sheets stacked one on another at a time, respectively. Specifically, in conventional insertion systems, multiple sheets inserted into a single envelope are regarded as "a set" and generally subject to identical folding method.

For example, JP-2003-002527-A proposes an insertion system that includes multiple feeding units to feed first and second enclosures, a first transport unit to transport the first enclosure through a first route individually and sequentially, and a second transport unit to transport a set of second enclosures through a second route. The second transport unit stacks the set of second enclosures on the first enclosure.

Although this insertion system can offer a variety of folding and insertion processing, to insert the sheet folded in single-sheet folding and sheets folded in batch folding into an identical envelope, it is necessary to set those sheets manually in the first and second transport units, respectively, after those sheets are folded. That is, in this insertion system, single-sheet folding and batch folding cannot be designated at a time.

BRIEF SUMMARY OF THE INVENTION

In view of the foregoing, one embodiment of the present invention provides an insertion system that includes a folding device to perform either single-sheet folding to fold a single sheet at a time or batch folding to fold multiple sheets together at a time, an insertion device to insert into an envelope the sheet folded by the folding device, and a batch setting unit to designate an option of folding and insertion processing for multiple sheets at a time. When multiple sheets are processed by the folding device and the insertion device, either the single-sheet folding or the batch folding can be designated for the multiple sheets at a time using the batch setting unit.

Another embodiment provides an insertion method that includes a step of selecting whether a processing option of multiple sheets processed by a folding device and a insertion device is designated at a time or for each of the multiple sheets, a step of designating either single-sheet folding to fold a single sheet at a time or batch folding to fold multiple sheets together at a time according to selection made at the step of selecting, a step of folding the multiple sheets according to a designated folding method, and a step of inserting into either a single envelope or respective envelopes the sheets folded according to the designated folding method.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
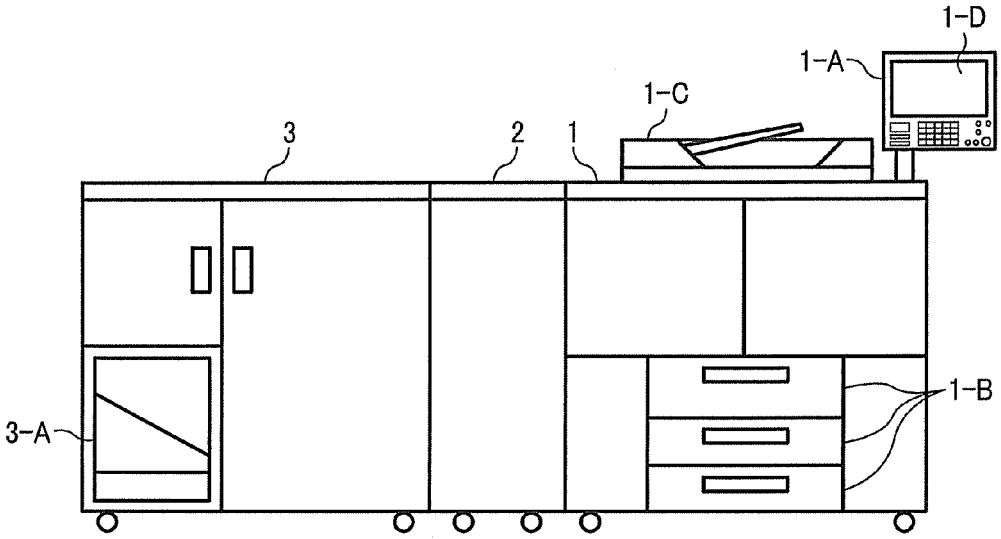
FIG. 1 is a front view illustrating a configuration of an insertion system according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an insertion system or image forming system according to an embodiment of the present invention is described.

FIG. 1 illustrates a configuration of the insertion system according to an embodiment of the present invention.

In FIG. 1, the insertion system according to the present embodiment includes an image forming apparatus 1, a folding device 2, and an insertion device or enclosing device 3.

Above the image forming apparatus 1, a control panel 1-A and an automatic document feeder (ADF) 1-C are provided. The control panel 1-A includes a display 1-D (shown in FIG. 12). Additionally, multiple feed cassettes 1-B are provided beneath the image forming apparatus 1. At least one of the multiple feed cassettes 1-B serves as an enclosure container in which sheets to be inserted into envelopes (hereinafter also "enclosures") are stored.

The insertion device 3 is connected to a discharge side of the image forming apparatus 1 or the folding device 2, and a stack tray 3-A is provided extreme downstream in the image forming system. The stack tray 3-A can accommodate envelopes after enclosures are inserted therein.

For example, the image forming apparatus 1 is a multifunction peripheral (MFP).

The folding device 2 is connected to a downstream side of the image forming apparatus 1 and capable of folding sheets in two (i.e., center folding) and into Z-like shape, double door-like shape. Additionally, the folding device 2 can perform single-sheet folding to fold a single sheet at a time as well as batch folding to fold multiple sheets lying on top of another at a time.

One of the multiple feed cassettes 1-B can store envelopes, and another feed cassette 1-B can store sheets of recording media to be inserted in the envelopes (hereinafter "enclosures"). To insert the enclosures in the envelopes in this system, the enclosures and the envelopes are transported to the insertion device 3. Before insertion, the folding device 2 folds the enclosures as required. Then the insertion device 3 inserts the enclosures in the respective envelopes, after which the envelopes are discharged onto the stack tray 3-A.

It is to be noted that, although the insertion device 3 inserts enclosures on which images have been formed by the image forming apparatus 1 into envelopes in the present embodiment, the enclosure is not limited thereto. For example, sheets stored in the feed cassette 1-B may be fed to the folding device 2 without image formation. Alternatively, the insertion system may include another enclosure container, and enclosures may be fed therefrom to the folding device 2.

Figure 2:
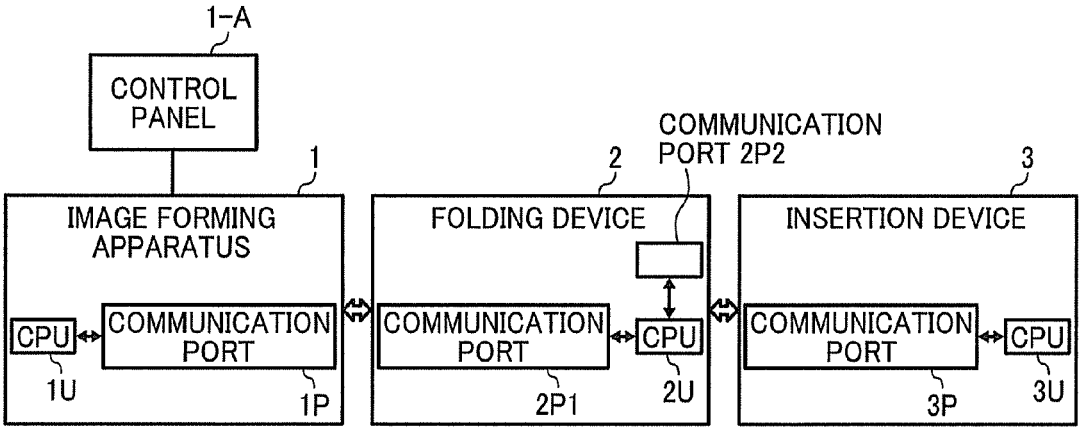
FIG. 2 is a block diagram illustrating a configuration of a control circuit of the insertion system.

FIG. 2 is a block diagram illustrating a schematic configuration of a control circuit of the image forming system shown in FIG. 1.

Referring to FIG. 2, in the insertion system according to the present embodiment, the folding device 2 as well as the insertion device 3 is connected to the image forming apparatus 1 to enable online control of the devices. The image forming apparatus 1, the folding device 2, and the insertion device 3 respectively include central processing units (CPUs) 1U, 2U, and 3U, and storage units (memory units) such as random-access memories (RAMs). Additionally, the image forming apparatus 1 includes a communication port 1P, the folding device 2 includes communication ports 2P1 and 2P2, and the insertion device 3 includes a communication port 3P. The image forming apparatus 1, the folding device 2, and the insertion device 3 can communicate with each other via the communication ports 1P, 2P1, 2P2, and 3P. The control panel 1-A is connected to the image forming apparatus 1 via an interface (I/F) and displays various indications described later, instructed by the CPU 1U of the image forming apparatus 1. Users can input instructions or data into the image forming apparatus 1 by pressing keys on the control panel 1-A or touching the display 1-D.

Figure 3:
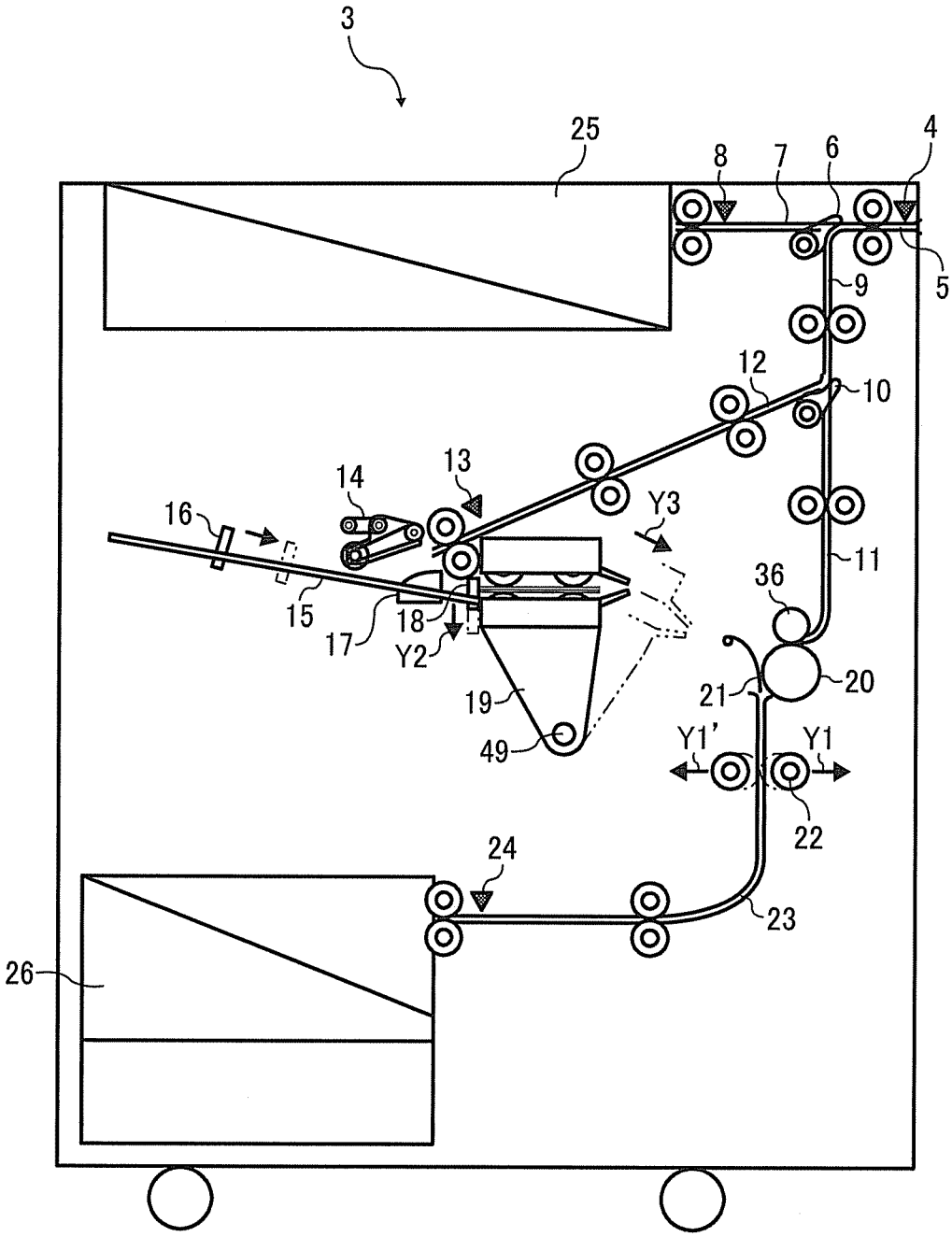
FIG. 3 illustrates an interior of an insertion device included in the insertion system.

FIG. 3 illustrates an interior of the insertion device 3 according to the present embodiment.

The envelopes set in the feed cassette 1-B of the image forming apparatus 1 are fed to an image forming unit inside the image forming apparatus 1, and the image forming unit prints addresses and the like on the envelopes, after which the envelopes are transported to the insertion device 3. The envelope enters an entrance path 5 of the insertion device 3, and an entry detector 4 detects the envelope. Then, the respective conveyance rollers are driven, thus starting transporting the envelope.

In FIG. 3, a pivotable upper separation pawl 6 is at an upper position to guide the envelope to a lower conveyance path 9, blocking an upper conveyance path 7. Thus, the envelope is transported along the lower conveyance path 9. Additionally, a pivotable lower separation pawl 10 is provided at a bifurcation position from the lower conveyance path 9 between a vertical conveyance path 11 and an enclosure conveyance path 12. To guide the envelope, the lower separation pawl 10 pivots counterclockwise in FIG. 3 to a position to open the vertical conveyance path 11. Thus, the envelope is guided to the vertical conveyance path 11. A pair of chuck rollers 20 and 36, provided extreme downstream in the vertical conveyance path 11, clamps a gusset of the envelope, retaining the envelope there, and waits for the enclosure. At this time, a pair of pivotable rollers 22 is withdrawn from the envelope in the directions indicated by arrows Y1 and Y1', respectively, not to contact the envelope.

In the image forming apparatus 1, an image reading unit reads image data of an original document sent by the ADF 1-C, and then a sheet sized corresponding to the size of the original document is fed from the feed cassette 1-B to the image forming apparatus 1. After an image is formed on the sheet, the sheet is transported to the folding device 2. According to instructions from the user, the sheet is either folded or not folded and then transported to the insertion device 3.

The enclosure enters the entrance path 5, and the entry detector 4 detects the enclosure. Then, the respective conveyance rollers are driven, thus starting transporting the enclosure.

In FIG. 3, the upper separation pawl 6 pivots to the upper position, thus guiding the enclosure to the lower conveyance path 9. The lower separation pawl 10 pivots to the position shown in FIG. 3, thus guiding the enclosure to the enclosure conveyance path 12. The enclosure passes by an enclosure detector 13 and is stacked on an intermediate tray 15. Subsequently, a return roller 14 moves to a position in contact with the intermediate tray 15 and transports the enclosure toward a back stopper 18. Further, a pair of side joggers 17 pushes the enclosure in the direction perpendicular to the direction in which the enclosure is transported, thus aligning the enclosure in the width direction. This operation is repeated until a set of enclosures inserted in one envelope is aligned on the intermediate tray 15.

After a bundle of enclosures is stacked on the intermediate tray 15, the back stopper 18 is withdrawn in the direction indicated by arrow Y2. A front stopper 16 starts moving in the direction indicated by an arrow shown in FIG. 3 to a position indicated by broken lines and transports the bundle of enclosures inside a pack unit 19. Then, the bundle of enclosures is clamped in nips between upper rollers 42 and lower rollers 43, arranged vertically (shown in FIG. 11), in the pack unit 19. After the enclosures are transported therein, the pack unit 19 pivots about a support point 49 in the direction indicated by arrow Y3 shown in FIG. 3. Then, a single enclosure or multiple enclosures to be inserted in a single envelope are transported by the upper rollers 42 and the lower rollers 43 of the pack unit 19 into the envelope retained by the pair of chuck rollers 20 and 36. After the enclosures are put in the envelope, the pivotable rollers 22 move in the direction opposite to the directions indicated by arrows Y1 and Y1', respectively, and start transporting the envelope to a discharge path 23. The envelope is transported through the discharge path 23, passes by an envelope detector 24, and is stacked on an envelope tray 26.

It is to be noted that the upper separation pawl 6 is provided at a bifurcation between the upper conveyance path 7 leading to an upper discharge tray 25 and the lower conveyance path 9. When the upper separation pawl 6 pivots clockwise from the position shown in FIG. 3 to a position to open the upper conveyance path 7, the envelope or the enclosure is discharged along the upper conveyance path 7 to the upper discharge tray 25. It is to be noted that, in FIG. 3, reference numeral 8 denotes a discharge detector to detect the object discharged to the upper discharge tray 25.

Figure 4:
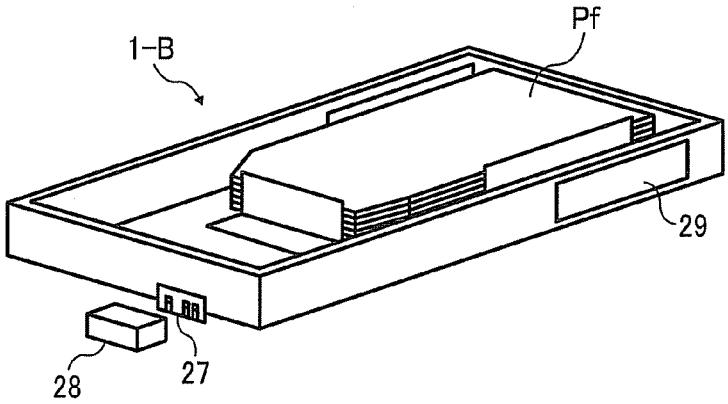
FIG. 4 is a perspective view that illustrates a feed cassette and a size detecting system in an image forming apparatus.

FIG. 4 is a perspective view that illustrates the feed cassette 1-B of the image forming apparatus 1 and a size detecting system to detect the size of envelopes or enclosures set in the feed cassette 1-B.

In FIG. 4, a planar size indicator 27 is attached to each feed cassette 1-B. Each size indicator 27 is sized according to the size of the sheets or envelopes contained therein. The main body of the image forming apparatus 1 includes a size detector 28 corresponding to each size indicator 27. When the feed cassette 1-B is set in the main body, the size detector 28 detects the size indicator 27 and thus recognizes the size of sheets or envelopes (in FIG. 4, envelopes Pt) contained in the feed cassette 1-B. Additionally, a size sticker 29 (i.e., a size label) is attached to a side face of the feed cassette 1-B so that the user can recognize the size or type of objects contained therein.

Figure 5:
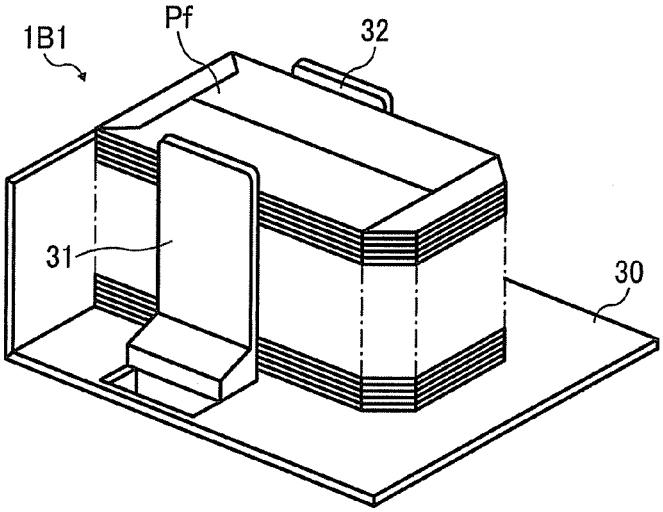
FIG. 5 is a perspective view that illustrates a feed cassette and a size detecting system in an image forming apparatus.
Figure 6:
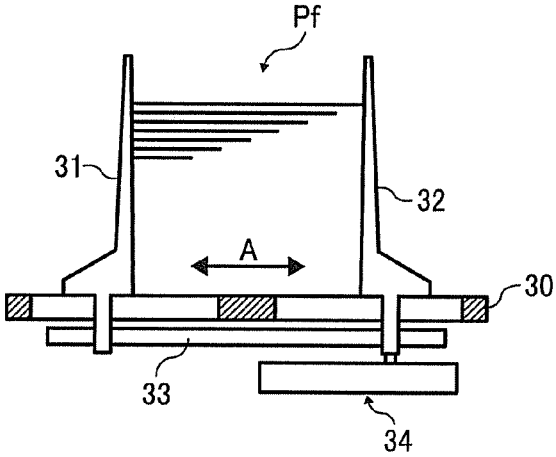
FIG. 6 is a lateral cross-sectional view of the configuration shown in FIG. 5.

FIG. 5 is a perspective view that illustrates a variation of the feed cassette 1-B of the image forming apparatus 1 and the size detecting system to detect the size of the envelope or enclosure stored therein. FIG. 6 is a cross-sectional view of the feed cassette and the size detecting system shown in FIG. 5.

A feed cassette 1B1 shown in FIGS. 5 and 6 includes a bottom plate 30 on which the envelopes Pf are stacked and a pair of side guides 31 and 32 slidable in a direction indicated by arrow A shown in FIG. 6, along a guide rod 33. The envelopes Pf are set in a center portion of the bottom plate 30, pushed by the side plates 31 and 32. Additionally, a size detector 34 is provided beneath the bottom plate 30. The size detector 34 detects the position of the side guide 32 to detect the size of the objects (in FIGS. 5 and 6, envelopes Pt) stacked on the bottom plate 30. More specifically, the size detector 34 compares the detected position of the side guide 32 with size data stored preliminarily therein and thus recognizes the size of the sheets or the envelopes Pf set on the bottom plate 30. For example, a variable-resistance position detector can be used as the size detector 34. The CPU 1U can easily detect the size of the objects contained in the sheet cassette 1B1 based on the resistance value output by the variable-resistance type position detector or changes in the resistance.

Figure 7:
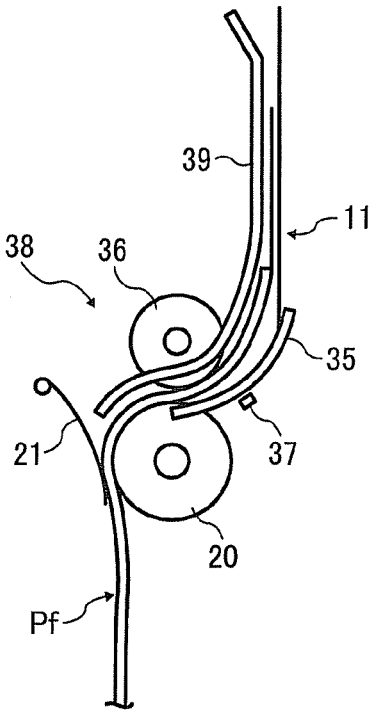
FIG. 7 is a cross-sectional view that illustrates a main portion of an envelope chuck unit in the insertion device.

FIG. 7 is a cross-sectional view that illustrates a main portion of an envelope chuck unit in the insertion device 3.

In FIG. 7, the lower chuck roller 20 and the upper chuck roller 36, provided extreme downstream in the vertical conveyance path 11, together form an envelope chuck unit 38. The chuck rollers 20 and 36 are arranged substantially vertically in FIG. 7 and can rotate while pressing against each other, forming a nip portion therebetween. The chuck rollers 20 and 36 may be rollers, cones, or spheres. Envelope guides 35 and 39 to guide the envelope Pf to the nip portion between the chuck rollers 20 and 36 are provided upstream from the chuck rollers 20 and 36 in the vertical conveyance path 11 in the direction in which the envelope is transported (hereinafter "envelope conveyance direction"). An envelope detector 37 is provided on an upstream side of the nip portion in the envelope conveyance direction. The unsealing sheet 21 in contact with the lower chuck roller 20 is formed of a plastic sheet such as Mylar® and can deform elastically. The unsealing sheet 21 is provided at such a position that a part of the unsealing sheet 21 can enter an opening Pon (shown in FIG. 8) of the envelope Pf supported by the chuck rollers 20 and 36, thereby unsealing the envelope Pf.

The envelope guides 35 and 39 guide the envelope Pf from the vertical conveyance path 11 to the nip portion between the chuck rollers 20 and 36 and further downward from the nip portion between the chuck rollers 20 and 36 along a circumferential surface of the lower chuck roller 20.

The unsealing sheet 21 may be a thin resin film member and positioned adjacent to the lower chuck roller 20. An upper side of the unsealing sheet 21 is fixed, and, in an ordinary state, a portion of the unsealing sheet 21 adjacent to a lower end portion 21*a* (shown in FIG. 8) thereof is pressed against the lower chuck roller 20 with a predetermined pressure due to the elasticity of the material of the unsealing sheet 21.

Figure 8:
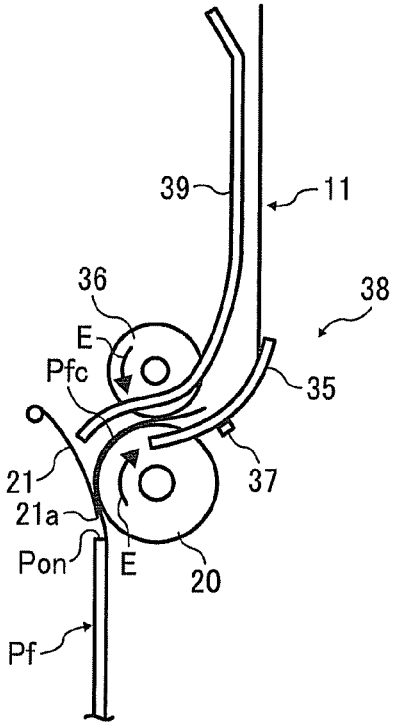
FIG. 8 is a cross-sectional view that illustrates the main portion of the envelope chuck unit, in which an opening of the envelope is positioned beneath a lower end of an unsealing sheet.
Figure 9:
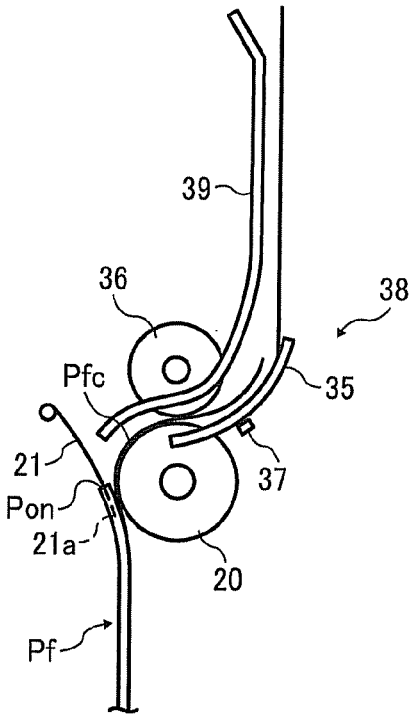
FIG. 9 is a cross-sectional view that illustrates the main portion of the envelope chuck unit, in which the lower end of the unsealing sheet is in the envelope.

FIG. 8 is a cross-sectional view of the main portion of the envelope chuck unit 38 and illustrates a state in which the opening Pon of the envelope Pf is positioned beneath the lower end portion 21*a* of the unsealing sheet 21. FIG. 9 is another cross-sectional view of the main portion of the envelope chuck unit 38, and the lower end portion 21*a* of the unsealing sheet 21 is in the envelope Pf in FIG. 9.

In the envelope chuck unit 38, the envelope guides 35 and 39 guide the envelope Pf to the nip portion between the chuck rollers 20 and 36 when the envelope Pf is transported downward in FIG. 8. Subsequently, the chuck rollers 20 and 36 rotate and transport the envelope Pf between the chuck roller 20 and the unsealing sheet 21. When the sheet or enclosure is guided into the envelope Pf, the envelope Pf is stopped at such a position that a flap Pfc of the envelope Pf is clamped by the chuck rollers 20 and 36 as shown in FIG. 8. More specifically, when the envelope detector 37 detects passage of an end of the flap Pfc of the envelope Pf, the CPU 3U stops a driving motor that drives the chuck rollers 20 and 36, thus stopping the envelope Pf. At that time, the opening Pon of the envelope Pf is positioned lower than the lower end portion 21*a* of the unsealing sheet 21.

Figure 10:
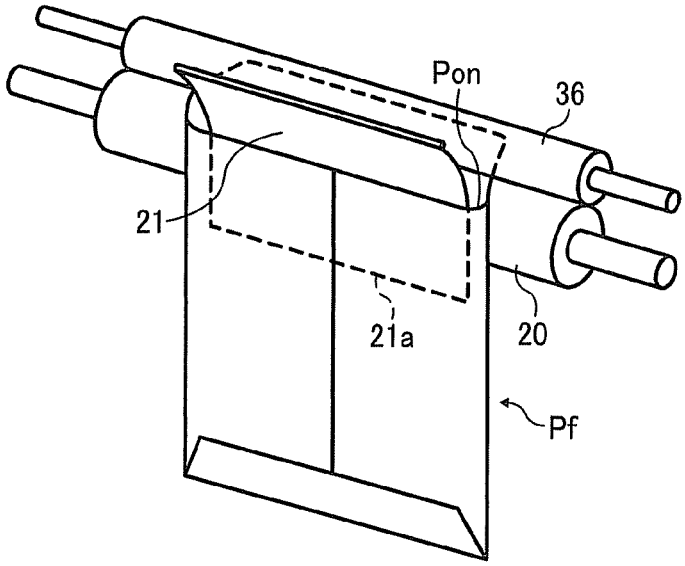
FIG. 10 is a perspective view that illustrates a state in which reverse rotation of chuck rollers is stopped, thereby stopping the envelope.

Subsequently, the CPU 3U rotates the chuck rollers 20 and 36 in reverse, which is the direction indicated by arrow E shown in FIG. 8. Thus, the envelope Pf is switchbacked and transported upward in the vertical conveyance path 11. At that time, because the lower side of the unsealing sheet 21 is in contact with the flap Pfc of the envelope Pf due to its elasticity, the lower end portion 21*a* of it enters the opening Pon of the envelope Pf as shown in FIG. 9. The reverse rotation of the chuck rollers 20 and 36 is stopped in this state, and upward conveyance of the envelope Pf is stopped, as shown in FIG. 10. In the state shown in FIG. 10, the envelope Pf is opened by the lower end portion 21*a* of the unsealing sheet 21 that is in the opening Pon of the envelope Pf.

Figure 11:
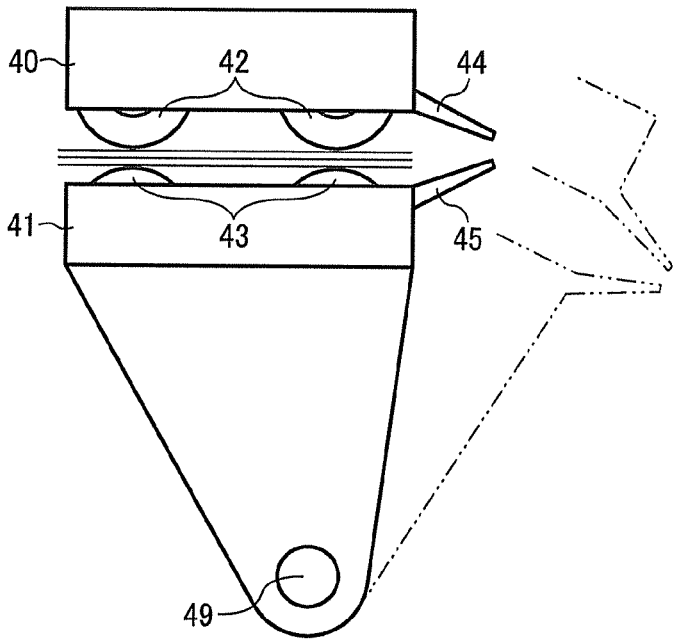
FIG. 11 is a front view of a pack unit of the insertion device.

FIG. 11 is a front view illustrating a configuration of the pack unit 19 of the insertion device 3.

In the configuration shown in FIG. 11, the pack unit 19 includes an upper pack portion 40 and a lower pack portion 41, and the upper rollers 42 and the lower rollers 43 are rotatively attached to the upper pack portion 40 and a lower pack portion 41, respectively. Additionally, entry guides 44 and 45 are respectively provided on the right end sides of the upper pack portion 40 and the lower pack portion 41 in FIG. 11. Base ends (proximal ends) of the entry guides 44 and 45 are rotatively supported by the upper pack portion 40 and the lower pack portion 41, respectively, and distal end sides of the entry guides 44 and 45 are biased toward each other by springs with a relatively small pressure, respectively. With this configuration, when a bundle of enclosures passes between the entry guides 44 and 45, the entry guides 44 and 45 are pushed away from each other. Thus, the resistance that the bundle of enclosures receives when the bundle is transported can be lower.

The pack unit 19 pivots about the support point 49 supporting the pack unit 19, and the entry guides 44 and 45 are inserted between the flap Pfc and the unsealing sheet 21, which is on standby at the position shown in FIG. 10. In this state, the front stopper 16 moves in the direction indicated by the arrow shown in FIG. 3 as described above, and the upper and lower rollers 42 and 43 are driven. Then, the enclosure passes between the entry guides 44 and 45 and is inserted in the envelope Pf.

Figure 12:
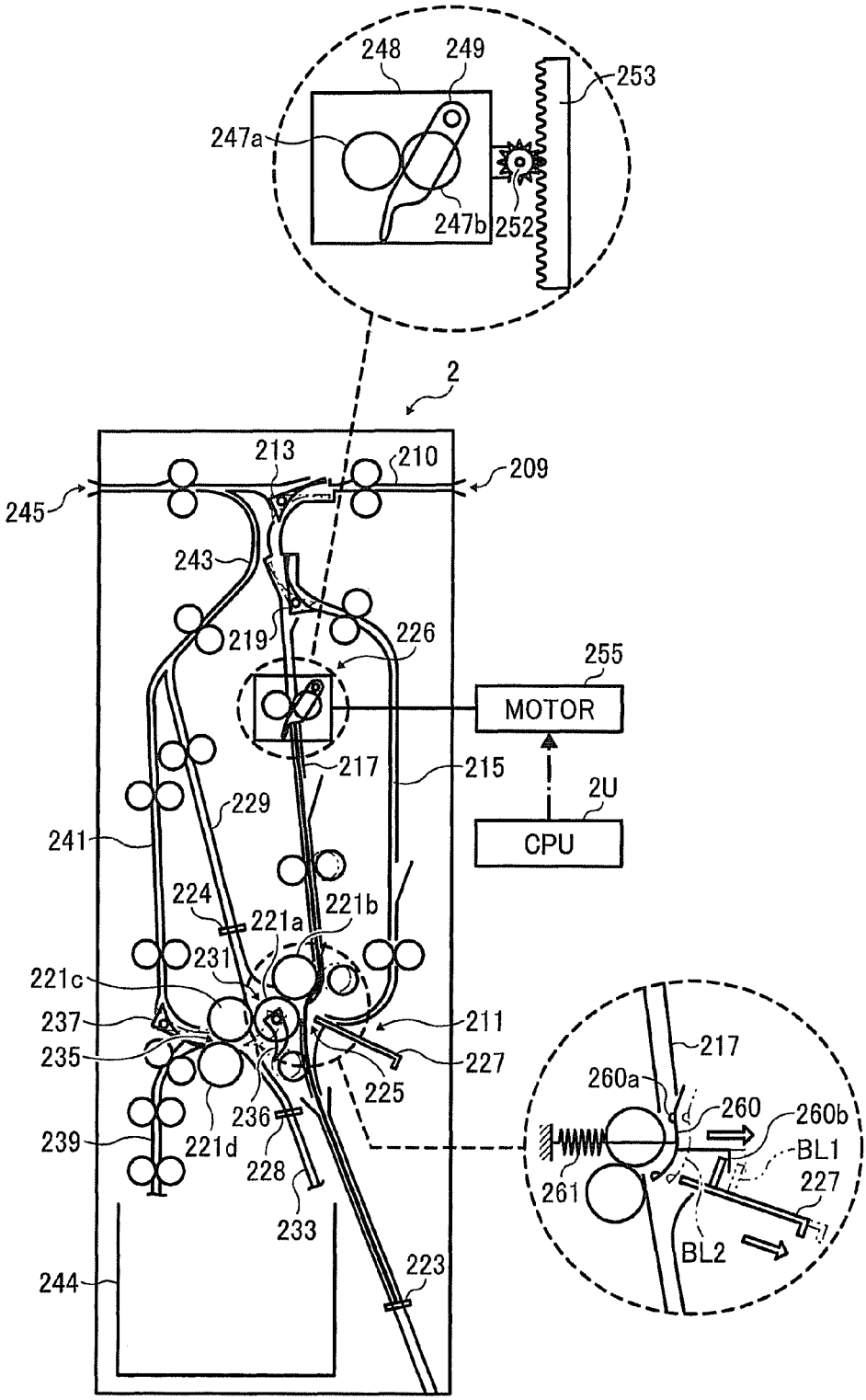
FIG. 12 is a vertical cross-sectional view that illustrates an interior of a folding device, and a bundle of sheets is retained in a second conveyance path.

FIG. 12 is a vertical cross-sectional view that illustrates an interior of the folding device 2.

Referring to FIG. 12, the folding device 2 includes a sheet inlet 209, a straight conveyance path 210 extending therefrom straight to a sheet outlet 245, and a first switching pawl 213. To fold sheets, the first switching pawl 213 changes the sheet conveyance rout from the straight conveyance path 210 to the route leading to a folding unit 211. After folded, the sheet is conveyed through a seventh conveyance path 243 and is returned to the straight conveyance path 210 at a position downstream from the first switching pawl 213. Then, the sheet is discharged from the sheet outlet 245.

The sheet conveyance route bifurcated at the first switching pawl 213 includes first, second, second, fourth, fifth, sixth, and seventh conveyance paths 215, 217, 229, 233, 239, 241, and 243. A second switching pawl 219 is provided downstream from the first switching pawl 213 in the sheet conveyance direction toward the folding unit 211 to switch the route between the first conveyance path 215 and the second conveyance path 217 serving as a sheet retaining channel. A downstream end of the first conveyance path 215 merges into the second conveyance path 217, and a pair of first folding rollers 221*a* and 221*b* is provided at the position where the two paths merges with each other. Additionally, a first stopper 223 is provided on the downstream side of the second conveyance path 217. The first stopper 223 is movable in the sheet conveyance direction and regulates the leading edge of the sheet. The sheet can be retained in the second conveyance path 217 with its leading edge in contact with the first stopper 223.

The first folding rollers 221*a* and 221*b* press against each other, thus forming a first folding nip 225 therebetween, and a pusher 227 is disposed facing the first folding nip 225. The pusher 227 guides the leading edge of the sheet being conveyed through the first conveyance path 215 to the first folding nip 225 and pushes the leading edge of the sheet retained in the second conveyance path 217 to the first folding nip 225. A movable roller unit 226 is provided in the second conveyance path 217 and positioned between the second switching pawl 219 and the first folding nip 225.

The third conveyance path 229 and a second folding roller 221*c* are disposed downstream from the first folding nip 225. The second folding roller 221*c* presses against the first folding roller 221*a*, thus forming a second folding nip 231. The fourth conveyance path 233 and a third folding roller 221*d* are provided downstream from the second folding nip 231. The third folding roller 221*d* presses against the second folding roller 221*c*, thus forming a third folding nip 235. A third switching pawl 236 is provided to a shaft of the first folding roller 221*a* to change the destination of the sheet between the fourth conveyance path 233 and the third folding nip 235.

Additionally, a switching pawl 237 is provided downstream from the third folding nip 235 to change the destination of the sheet between the fifth and sixth conveyance paths 239 and 241. A downstream end of the fifth conveyance path 239 is connected to a stacker 244 so that the folded sheet can be discharged thereto. The sixth conveyance path 241 merges with the downstream end of the third conveyance path 229 and communicates with the seventh conveyance path 243.

Pairs of conveyance rollers are provided in the first, second, third, fifth, sixth, and seventh conveyance paths 215, 217, 229, 239, 241, and 243. Additionally, second and third stoppers 224 and 236 are respectively provided to the third and fourth conveyance paths 229 and 233. The second and third stoppers 224 and 236 can project into and withdrawn from the third and fourth conveyance paths 229 and 233 and movable in the sheet conveyance direction.

The movable roller unit 226 includes a pair of conveyance rollers 247*a* and 247*b* pressing each other, a holding member 249 to press a trailing-end portion of the sheet being retained in the second conveyance path 217, and a frame 248 to hold these components. Both ends of each of the conveyance rollers 247*a* and 247*b* are rotatably supported by front and back plates of the frame 248. Each of the conveyance rollers 247*a* and 247*b* consists of multiple rollers disposed coaxially and at intervals in the sheet width direction.

The holding member 249 includes multiple pieces projecting from a supporter that parallels the roller shafts of the conveyance rollers 247*a* and 247*b*. These pieces are arranged at intervals so that these pieces can enter a clearance between the adjacent rollers.

Figure 16:
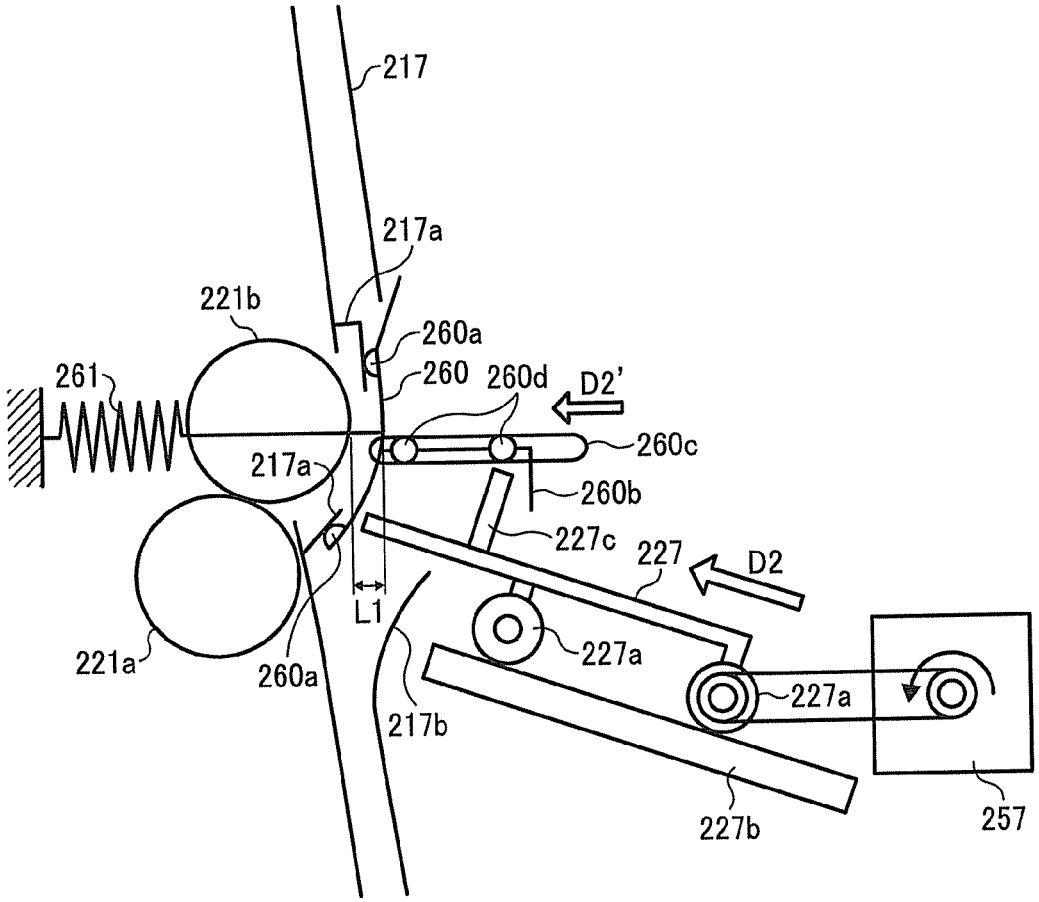
FIG. 16 illustrates a state in which a movable planar guide is in contact with a pair of guide plates.
Figure 17:
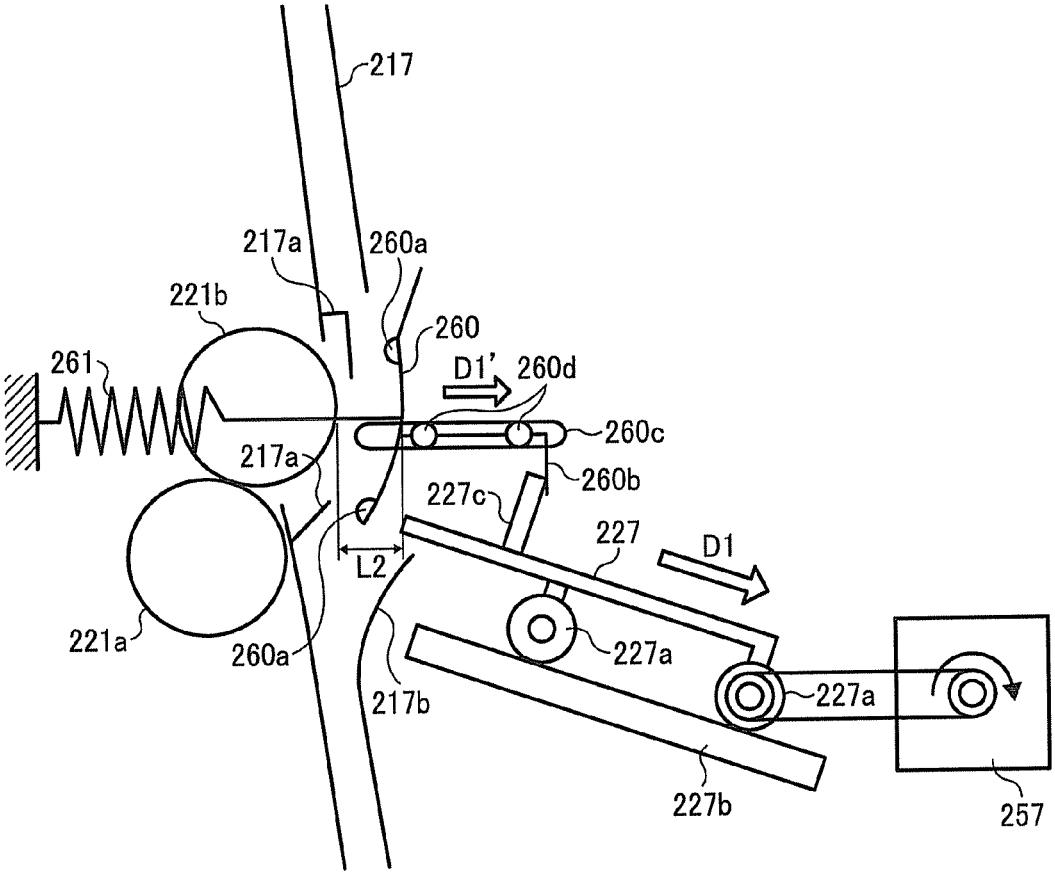
FIG. 17 illustrates a state in which the movable planar guide is away from the pair of guide plates.

FIGS. 15A through 15D illustrate movement of the holding member 249. FIGS. 16 and 17 illustrate movement of a movable planar guide 260. It is to be noted that FIGS. 16 and 17 illustrate relative positions between the movable planar guide 260 and the pusher 227 in single-sheet folding and batch folding to fold multiple sheets, respectively.

Figure 15A:
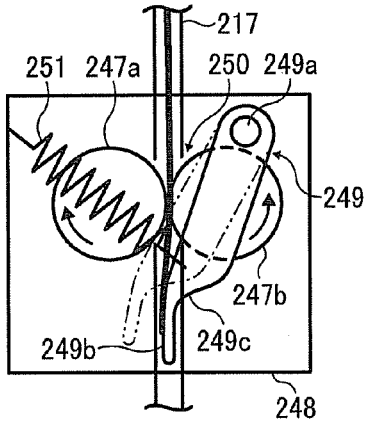
FIGS. 15A through 15E illustrate movement of the pusher.

As shown in FIG. 15A, the holding member 249 includes a shaft whose ends 249*a* are movably supported by the front and back plates of the frame 248, and the ends 249*a* are hereinafter referred to as "base ends 249*a*". The base ends 249*a* are on the side of the conveyance roller 247*b* and across the second conveyance path 217 from the conveyance roller 247*a*. The holding member 249 is pushed to the conveyance roller 247*a* by elastic force of a tension coil spring 251 fixed to the frame 248. Additionally, the holding member 249 is inhibited by a stopper from rotating toward the conveyance roller 247*a*. As indicated by broken lines shown in FIG. 15A, the position of the movable end of the holding member 249 is retained to block the second conveyance path 217. The elastic force (spring constant) of the tension coil spring 251 is set such that, when the holding member 249 is pushed by the sheet being conveyed to the second conveyance path 217, the holding member 249 rotates in the direction opposite the direction in which the tension coil spring 251 exerts elastic force, that is, the holding member 249 opens the second conveyance path 217.

Additionally, a guide face 249*b* is formed in the movable end portion of the holding member 249 on the side of the conveyance roller 247*a* (on the left in FIG. 15A). The guide face 249*b* guides the sheet being conveyed to the second conveyance path 217 toward a side of the sheet being retained in the second conveyance path 217. Further, a pressing face 249*c* is formed on the right side (away from the conveyance roller 247*a*) of the movable end portion of the holding member 249 shown in FIG. 15A to push the trailing-end portion of the sheet being retained in the second conveyance path 217. In other words, the pressing face 249*c* and the guide face 249*b* are on the opposite sides.

Referring back to FIG. 12, a shift unit (rack-and-pinion) to move the movable roller unit 226 is provided to a side of the frame 248. The shift unit includes a pinion 252 and a rack 253. The pinion 252 is provided to a side of the holding member 249 and engages the rack 253 that is disposed along the second conveyance path 217. The pinion 252 is driven by a first motor 255 controlled by the CPU 2U. With this configuration, the movable roller unit 226 is moved up and down in FIG. 12 along the second conveyance path 217 driven by the first motor 255.

As shown in the enlarged illustration in FIG. 12, the movable planar guide 260 to guide the sheet to the first stopper 223 is provided adjacent to the first folding rollers 221*a* and 221*b* in the second conveyance path 217. Projection 260*a* are respectively provided to the upper and lower ends of the movable planar guide 260, and upper and lower guide plates 217*a* are provided to sandwich a roller face of the folding roller 221*b*. As shown in FIGS. 16 and 17, the projections 260*a* are respectively elastically urged by the tension coil spring 261 to left-side faces in FIG. 16 (on the side of the first folding rollers 221*a* and 221*b*) of the upper and lower guide plates 217*a*. The movable planar guide 260 further includes an engagement member 260*b* that engages a projection 227*c* of the pusher 227.

When only a single sheet is folded, the movable planar guide 260 is kept at the position shown in FIG. 16 (i.e., position for single-sheet folding) with the projections 260*a* in contact with the respective guide plates 217*a* as shown in FIG. 16. When multiple sheets are folded at a time, the pusher 227 moves in the direction indicated by arrow D1 shown in FIG. 17 and accordingly pulls the engagement member 260*b* of the movable planar guide 260 in the direction indicated by arrow D' shown in FIG. 17. Together with the engagement member 260*b*, the movable planar guide 260 itself moves from the position for single-sheet folding to a position away from the guide plates 217*a* and in parallel to the position for single-sheet folding. The movable planar guide 260 is moved away from the pusher 227 using a stepping motor for driving the pusher 227. That is, this stepping motor serves as a second motor 257 (also shown in FIG. 13) and is commonly used for driving the movable planar guide 260 and the pusher 227.

It is to be noted that a guide shaft bearing 260*c* is provided along the direction in which the movable planar guide 260 moves, and the engagement member 260*b* of the movable planar guide 260 is fixed to a pair of guide shafts 260*d* slidably supported by the guide shaft bearing 260*c*. When the pusher 227 moves in the direction indicated by arrow D1, the projection 227*c* standing on the pusher 227 engages the engagement member 260*b*, resulting in the above-described movement. In single-sheet folding, when the pusher 227 returns in the direction indicated by arrow D2 shown in FIG. 16, engagement between the engagement member 260*b* and the projection 227*c* is released. Then, the movable planar guide 260 is moved in the direction indicated by arrow D' to the position shown in FIG. 16 by the tension coil spring 261.

With the above-described parallel movement of the movable planar guide 260, the clearance between the outer circumference of the folding roller 221*b* and the movable planar guide 260 can be adjusted for passing the bundle of sheets therethrough or folding a single or multiple sheets. It is to be noted that the movement of the movable planar guide 260 is not limited to parallel movement. For example, a fulcrum of rotation may be provided to an upstream side so that the movable planar guide 260 can pivot to increase the clearance in size on the downstream side. Additionally, in the present embodiment, the movable planar guide 260 can move according to the position of sheets as well as the thickness of sheets as shown in FIGS. 16 and 17.

The second motor 257 to drive the pusher 227 is a stepping motor capable of stopping the pusher 227 at a given position. Accordingly, the clearance (hereinafter "conveyance clearance") between the outer circumference of the folding roller 221*b* and the movable planar guide 260 can be changed by changing the driving step of the second motor 257 using the CPU 2U. Therefore, the conveyance clearance can be changed according to the number (or thickness) of sheets stacked one on another. The conveyance clearance is increased in size as the number of sheets increases. For example, the conveyance clearance may be 3 mm when the number of sheets is five or less, 4 mm when the number of sheets is from six to ten, and 6 mm when the number of sheets is eleven to twenty.

The user can select folding either a single sheet or multiple sheets at a time via the control panel 1-A. The number of sheets folded together can be input using the control panel 1-A.

Figure 13:
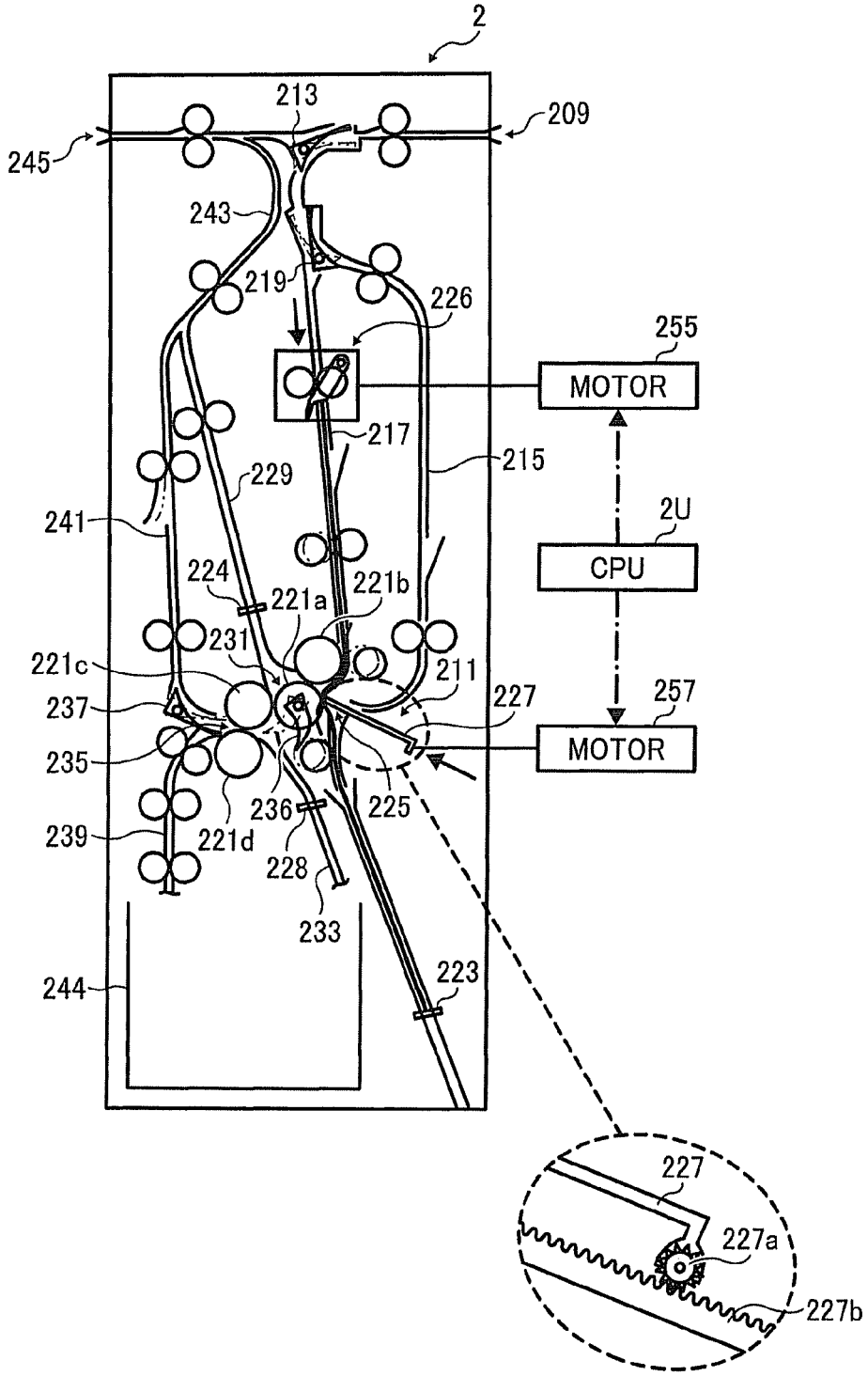
FIG. 13 illustrates a state in which the trailing-end portion of the bundle is pushed to cause the bundle to bulge, and a pusher guides the bundle to a first folding nip.
Figure 14:
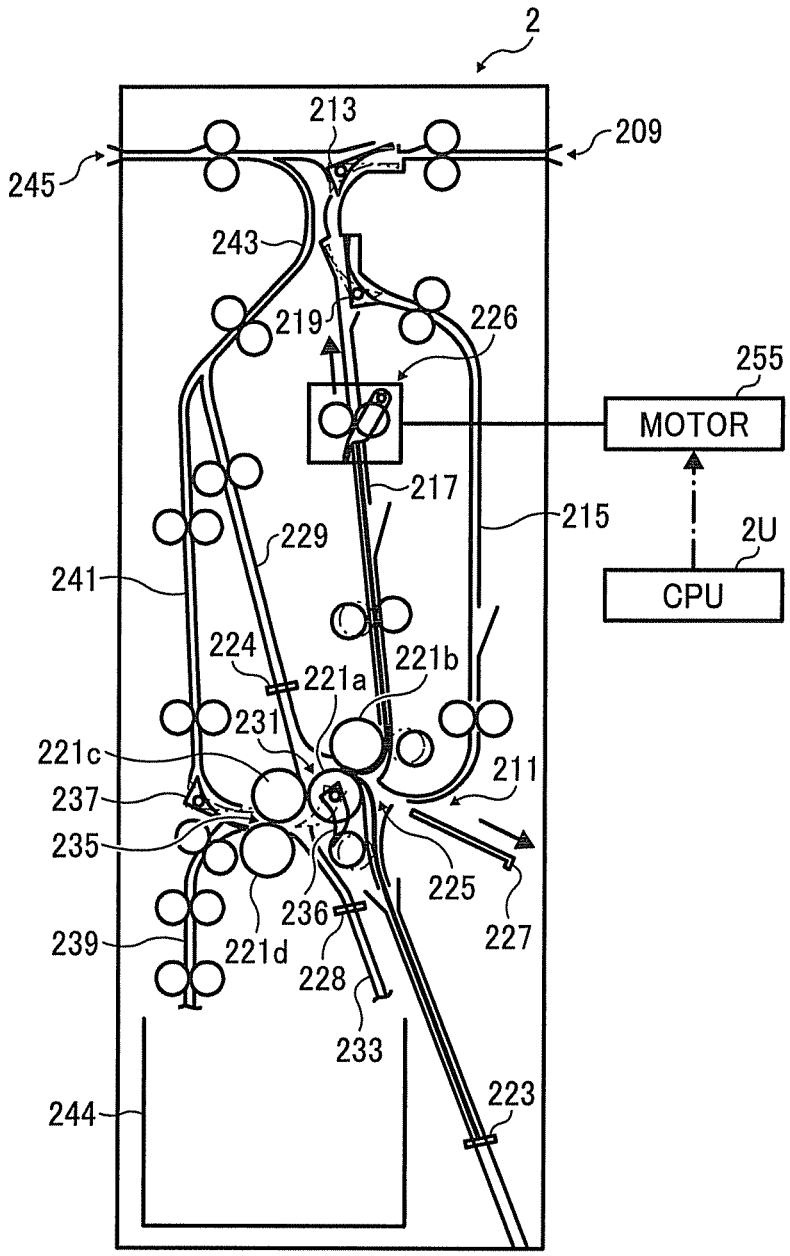
FIG. 14 illustrates a state in which a movable roller unit is moved to a position to receive the bundle.

Folding of sheets using the folding device 2 is described below with reference to FIGS. 12, 13, and 14. In FIG. 12, the bundle of sheets is retained in the second conveyance path 217. In FIG. 13, the trailing-end portion of the bundle is pushed to bulge the bundle, and the pusher 227 guides the bundle to the first folding nip 225. In FIG. 14, the movable roller unit 226 is moved to a position to receive the bundle (hereinafter "sheet receiving position").

In folding operation according to the present embodiment, the user selects "FOLDING" and then selects folding type, such as folding in two, via the control panel 1-A of the image forming apparatus 1. The CPU 2U sets a sheet receiving position for folding sheets of the first stopper 223 such that the distance in the sheet conveyance direction from the first folding nip 225 is reduced to the half. The distance from the first stopper 223 to the pressing face 249*c* of the holding member 249 is made slightly longer than the distance in the sheet conveyance direction. With this operation, the sheets can be folded without transporting the bundle of sheets after the sheets is retained.

It is to be noted that, when folding in three inward or outward is selected, the first stopper 223 is moved to the above-described position similarly to folding in two so that the distance from the first stopper 223 to the pressing face 249*c* is slightly longer than the distance in the sheet conveyance direction.

Additionally, as the pusher 227 moves to a home position indicated by solid lines shown in FIG. 12, the movable planar guide 260 moves to the position for single-sheet folding (indicated by solid lines shown in FIG. 12), thus narrowing the conveyance clearance. Alternatively, as the pusher 227 moves to the standby position shown in FIG. 16 (i.e., position BL1 indicated by broken lines shown in FIG. 12), the movable planar guide 260 moves to the position indicated by broken lines shown in FIG. 17 (i.e., position BL2 shown in FIG. 12), thus widening the conveyance clearance. The pusher 227 is driven by the second motor 257, controlled by the CPU 2U.

As illustrated in the enlarged view shown in FIG. 13, a pinion 227*a* is disposed on the trailing side (left side in FIG. 13). Being rotated by the second motor 257 that rotates the pinion 227*a* together with the pusher 227, the pusher 227 moves along a rack 227*b*. The position and velocity can be controlled by the CPU 2U.

Figure 15B:
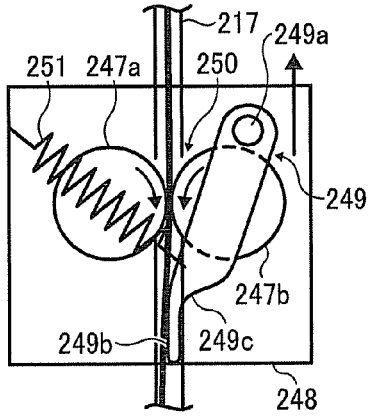

After the above-described preparation is completed, a first sheet on which an image have been formed by the image forming apparatus 1 is transported through the sheet inlet 209. The first and second switching pawls 213 and 219 guide the sheet to the second conveyance path 217, and the leading-end portion of the sheet enters a conveyance nip 250 between the conveyance rollers 247*a* and 247*b*. The leading-end portion of the sheet contacts the guide face 249*b* of the holding member 249 and then moves downstream while pushing away the holding member 249 as shown in FIG. 15B. The CPU 2U starts normal rotation of the first motor 255 at a timing at which the leading edge of the sheet reaches an end of the holding member 249, and the movable roller unit 226 is moved a distance M upward, that is, upstream in the sheet conveyance direction. For example, the distance M is 15 mm.

The leading edge of the sheet passes by the movable planar guide 260 and further the receiving plate 217*b* provided in the second conveyance path 217. After the sheet is thus forwarded from the upper haft of the second conveyance path 217 to the lower half of the second conveyance path 217, the second motor 257 is driven, and the pusher 227 is moved in the direction indicated by arrow D1 from the initial position to the standby position indicated by broken lines shown in FIG. 12, widening the conveyance clearance from the initial conveyance clearance L1 shown in FIG. 16 to the conveyance clearance L2 shown in FIG. 17 (L1<L2). It is to be noted that, if the movable planar guide 260 is moved in the direction indicated by arrow D1 before the first sheet comes, differences between (a step formed by the difference) between the clearance between the movable planar guide 260 and the folding roller 221*b* and that between the movable planar guide 260 and the receiving plate 217*b* is reduced. In this case, it is possible that the sheet is not guided to the conveyance path inside the receiving plate 217*b*, and the leading-end portion thereof is blocked by the upstream end of the receiving plate 217*b*, resulting in jamming.

Figure 15C:
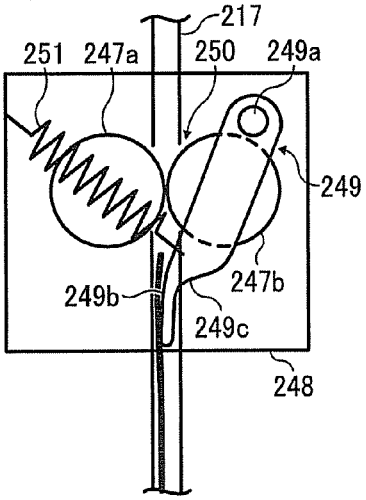
Figure 15D:
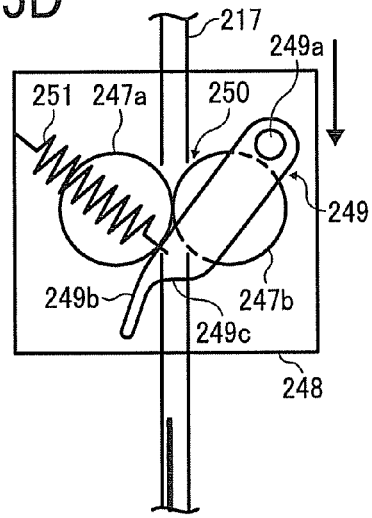
Figure 15E:
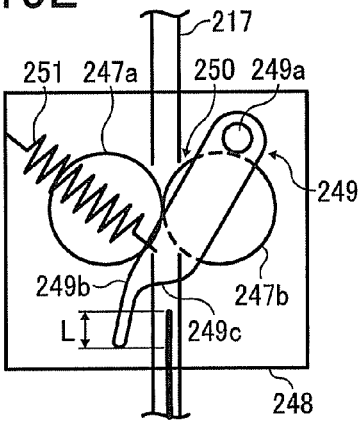

After the leading edge of the first sheet passes by the movable planar guide 260 and further the trailing edge thereof passes by the conveyance nip 250 between the conveyance rollers 247*a* and 247*b* as shown in FIGS. 15C and 15D, the sheet passes by the movable planar guide 260 under its own weight and falls until the leading edge thereof contacts the first stopper 223. When the leading edge of the sheet reaches the first stopper 223, the CPU 2U rotates the first motor 255 in reverse, thereby descending the movable roller unit 226 (downstream in the sheet conveyance direction). The CPU 2U stops the movable roller unit 226 such that the leading edge of the holding member 249 is at a distance L (e.g., 10 mm) down from the trailing edge of the sheet as shown in FIG. 15E.

When a second sheet reaches the movable roller unit 226, similarly to the first sheet, the leading edge contacts the guide face 249*b* of the holding member 249 and then moves, pushing away the holding member 249, as shown in FIG. 15A. The CPU 2U starts normal rotation of the first motor 255 at a timing at which the leading edge of the sheet reaches the end of the holding member 249, and the movable roller unit 226 is moved the distance M upward (upstream in the sheet conveyance direction). At that time, the trailing edge of the first sheet is covered with a leading-end portion of the holding member 249. Accordingly, the leading edge of the second sheet can be guided by the guide face 249*b* to a side of the first sheet without contacting the trailing-end portion of the first sheet being retained.

Although the movable planar guide 260 is at the position to widen the conveyance clearance to the conveyance clearance L2 when the second sheet is forwarded thereto, the second sheet can be prevented from being blocked by the upper end of the receiving plate 217*b* because the first sheet guides it. Thus, jamming of the sheet can be prevented. Additionally, resistance against sheet conveyance can be reduced because the conveyance clearance defined by the movable planar guide 260 is increased in conveyance of the second and subsequent sheets.

When the trailing edge of the sheet passes by the conveyance nip 250, the sheet slips down under its own weight until the leading edge thereof contacts the first stopper 223. When the leading edge of the sheet reaches the first stopper 223, the CPU 2U rotates the first motor 255 in reverse, thereby descending the movable roller unit 226 (downstream in the sheet conveyance direction). The CPU 2U stops the movable roller unit 226 such that the leading edge of the holding member 249 is at the distance L down from the trailing edge of the sheet as shown in FIG. 15E. In conveyance of a third and subsequent sheets, the movable roller unit 226 is moved as described above to retain the sheet in the second conveyance path 217. It is to be noted that to fold multiple sheets at a time, driven rollers of pairs of conveyance rollers provided to the second conveyance path 217 are disengaged from the respective driven rollers as shown in FIG. 12 not to apply a conveyance force to the sheet.

After the designated number of sheets to be folded together is retained in the second conveyance path 217, the holding member 249 is descended so that the sheets are aligned by the pressing face 249*c* in the sheet conveyance direction. Then, a pair of jogger fences aligns the sheets in the sheet width direction perpendicular to the sheet conveyance direction. Further, as shown in FIG. 13, the holding member 249 is moved down a predetermined distance to cause the sheets to bulge by a predetermined amount. Subsequently, the pusher 227 is driven to move the movable planar guide 260 in the direction indicated by arrow D2 shown in FIG. 16, thereby moving the bulging of the sheets toward the first folding nip 225. Then, the pusher 227 pushes the bulging of the sheets into the first folding nip 225, and thus the first folding rollers 221*a* and 221*b* fold the sheets in two. While the pusher 227 moves to the first folding nip 225, the movable planar guide 260 is moved to the position for single-sheet folding (solid lines shown in FIG. 12) in the direction indicated by arrow D2' by the spring force.

When bulging of the sheets is thus squeezed in the first folding nip 225, the holding member 249 is moved up, away from the trailing edges of the sheets, to the position to receive the sheet (initial position). Simultaneously, the pusher 227 is withdrawn to the standby position. The sheets folded in two are guided by the fourth switching pawl 37 to the sixth conveyance path 241 when the sheet is convened to a bookbinding device or to the fifth conveyance path 239 when the sheets are discharged to the stacker 244.

It is to be noted that, although the description relating to FIGS. 12 through 14 concerns folding sheets in two, the folding device 2 can adapt to folding sheets in three inward or outward, Z-shape, or a double door-like shape. Those folding types are known widely, and thus descriptions thereof are omitted. The first conveyance path 215 may be configured similarly to the second conveyance path 217 to be used as another sheet retaining channel in folding multiple sheets at a time. With this configuration, multiple sheets can be folded at a time even if the first conveyance path 215 is only the available sheet retaining channel depending on the folding type.

Figure 18:
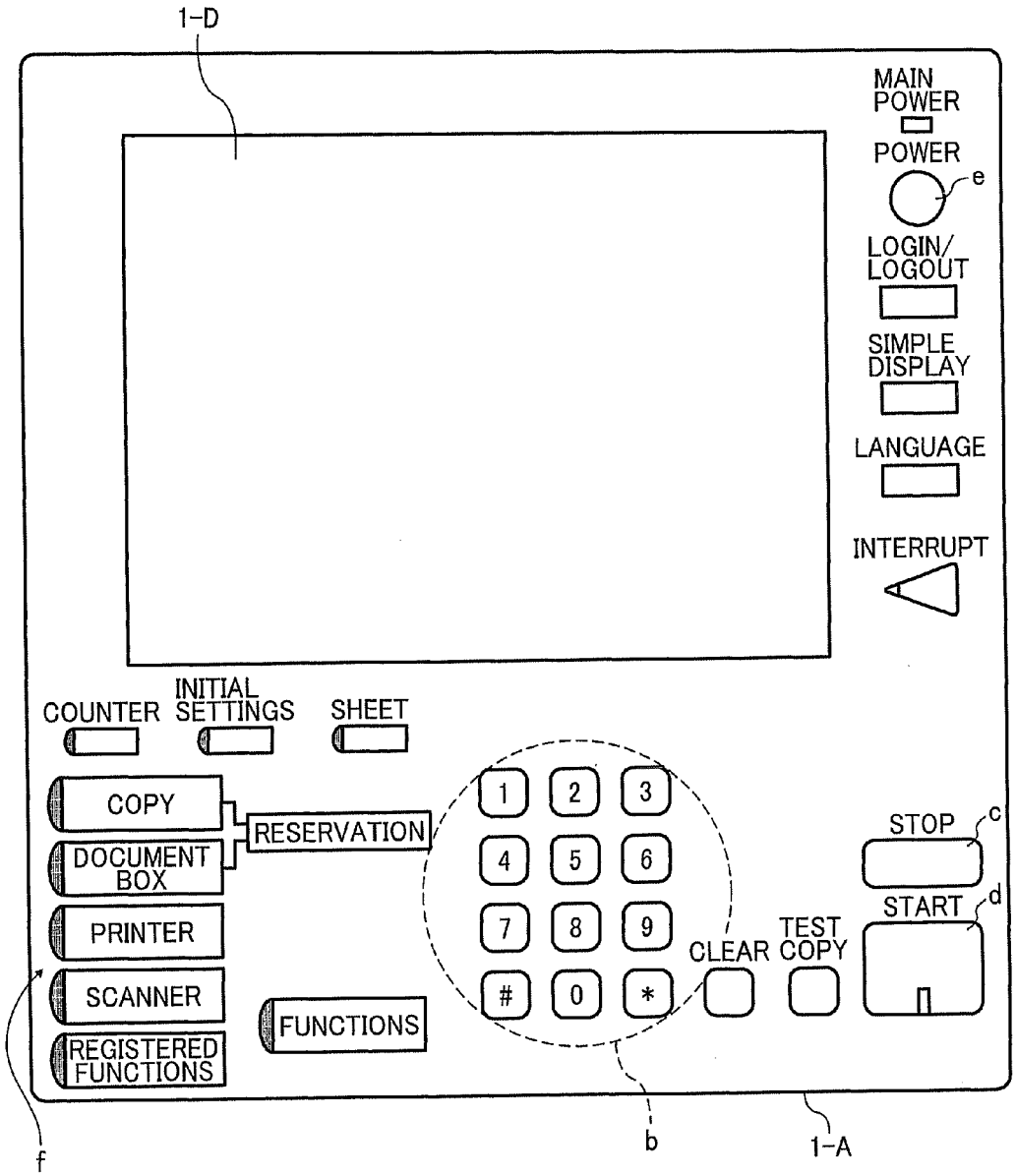
FIG. 18 is a front view of the control panel provided on an upper portion of the image forming apparatus.

FIG. 18 is a front view of the control panel 1-A provided on an upper face of the image forming apparatus 1.

Referring to FIG. 18, the control panel 1-A includes the display 1-D, a group of numeric keys b, a STOP key c, a START key d, a POWER button e, and a group of function selection keys f. The display 1-D displays various messages and input keys in layers. The user can input numbers by pressing the numeric keys b. The user can stop the processing by pressing the STOP key c. Pressing the START key d generates a trigger signal to start image formation. The user can turn on and off the image forming system by pressing the POWER button e. The group of function selection keys f includes keys with which the user selects copying, printing, scanning, or the like.

Figure 19:
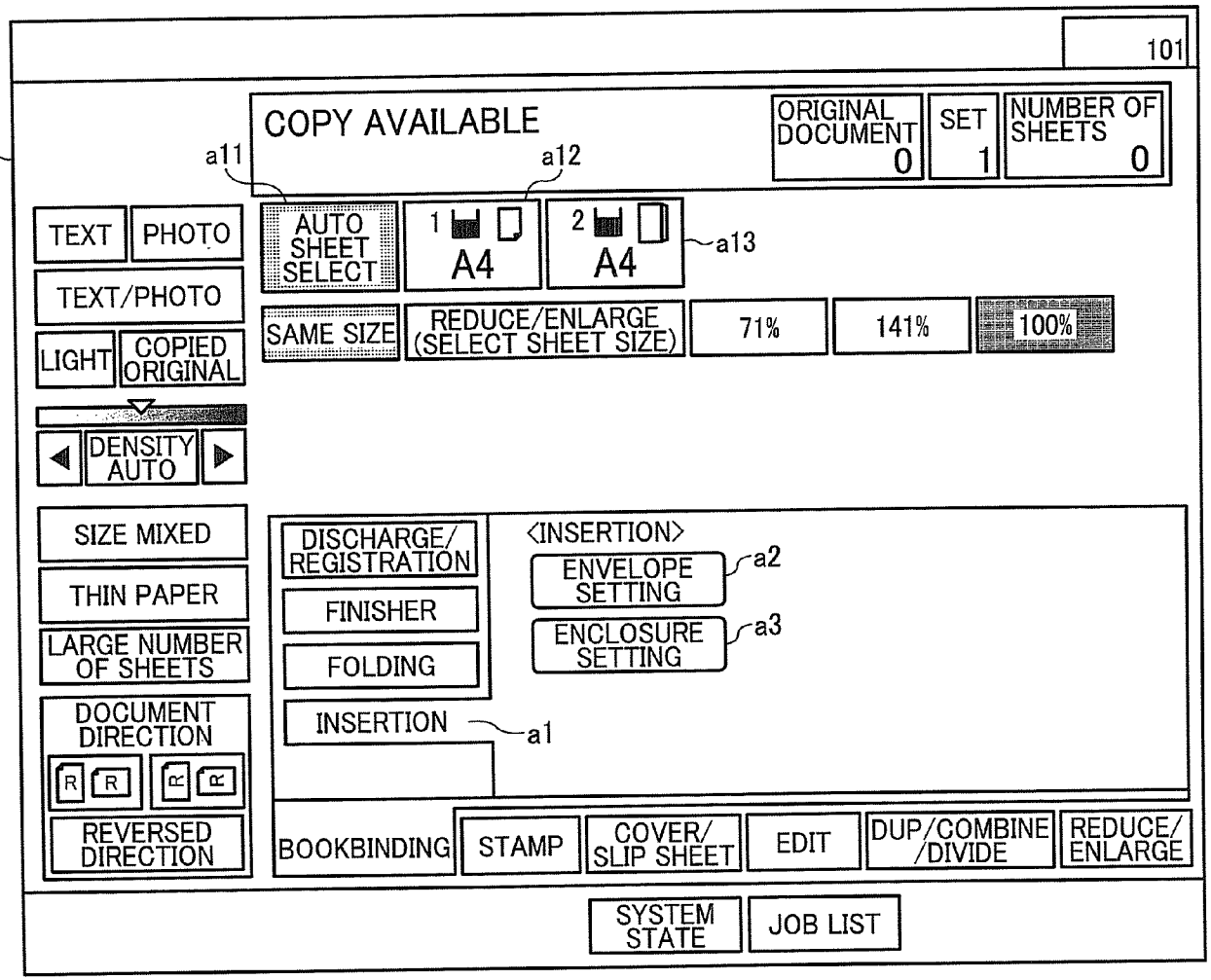
FIG. 19 illustrates indications on a display of the control panel shown in FIG. 18.

FIG. 19 illustrates indications on the display 1-D of the control panel 1-A shown in FIG. 12.

The indications shown in FIG. 19 appear when A4 size sheets are stored laterally in the first feed cassette 1-B (hereinafter "A4Y sheets"), and envelopes that accommodate A4Y sheets are stored in the second feed cassette 1-B. In the display shown in FIG. 19, an "AUTO SHEET SELECT" button all, a "SHEET SELECT" button (enclosure selection button) a12, and an "ENVELOPE SELECT" button a13 are provided. For example, the "AUTO SHEET SELECT" button all is pushed, and the selected sheet and envelope are displayed. It is to be noted that, although only one sheet type (enclosure type) and one envelope type are available in the configuration shown in FIG. 19, alternatively, multiple sheet types and multiple envelope types may be contained in multiple cassettes 1-B, and sheet type and envelope type may be selected from the multiple types.

[Insertion Setting]

To perform insertion of enclosures into envelopes, the user presses an INSERTION button a1 of an insertion tab on the display 1-D shown in FIG. 19. The insertion tab includes an ENVELOPE SETTING button a2 and an ENCLOSURE SETTING button a3 for setting images formed on envelopes and enclosures inserted in the envelope.

(1) Envelope Setting

Figure 20:
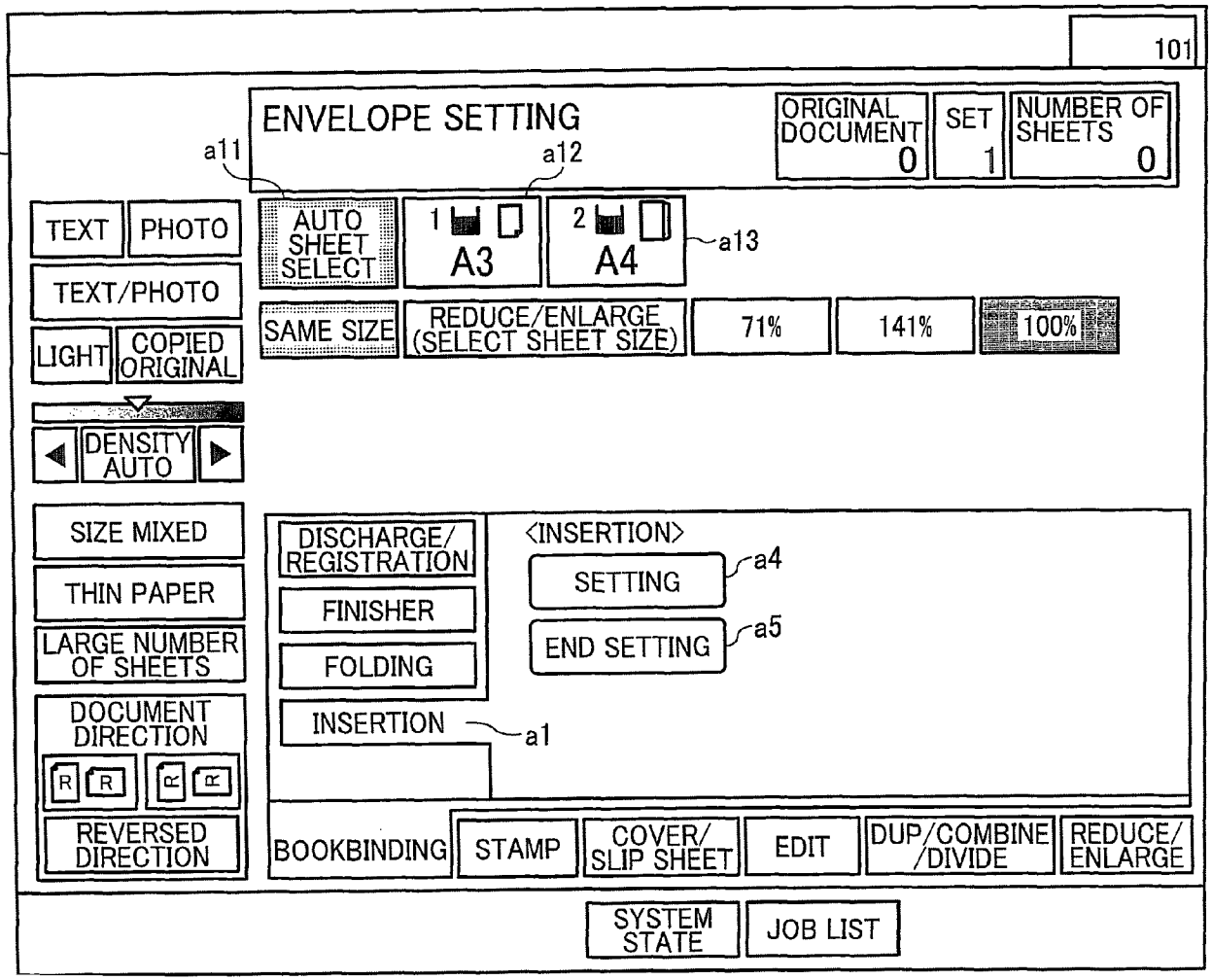
FIG. 20 illustrates a screen display on the control panel for envelope setting.

FIG. 20 illustrates indications for envelope settings on the display 1-D of the control panel 1-A. When the ENVELOPE SETTING button a2 is pressed on the display 1-D shown in FIG. 19, a setting screen on the lower layer appears as shown in FIG. 20. It is to be noted that, in envelope setting, only the envelope Pf is selectable. On the setting screen shown in FIG. 20, image formation on envelopes can be designated. Although setting of only typical items are described below, other items (e.g., image density, magnification, and the like) can be also set similarly to typical image forming apparatuses.

(2) Enclosure Selection

The sheet to be used is selected among those contained in the respective feed cassettes 1-B.

(3) Setting of Image Formation and Combination of Envelope Pf and the Enclosure

For example, addresses can be printed on the envelope Pf. How to input addresses is described later with reference to FIG. 21. It is to be noted that, although settings regarding envelopes is made via the control panel 1-A of the image forming apparatus 1 in the present embodiment, alternatively, those settings may be made from external devices such as computers or devices connected to a network such as a local area network (LAN).

(3) Completion of Settings

After necessary settings are made, the user can finish the setting regarding image formation on the envelope Pf by pressing an END SETTING button a5 on the insertion tab. Additionally, a SETTING button a4 is provided in the display 1-D shown in FIG. 20.

Figure 21:
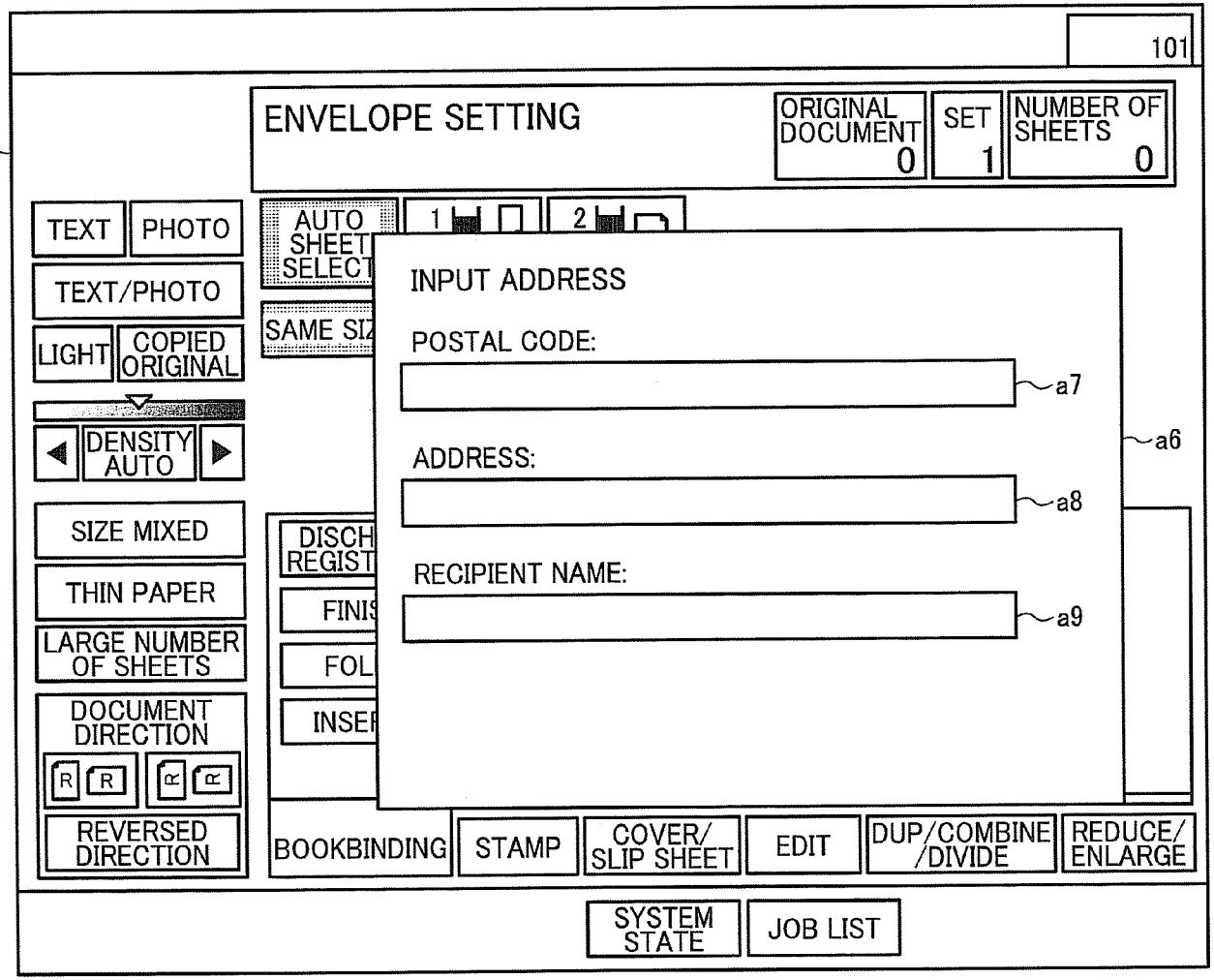
FIG. 21 illustrates an address input window, which appears when an envelope setting button is pressed on the control panel.

FIG. 21 illustrates an address input window a6 that appears on the control panel 1-A when the ENVELOPE SETTING button a2 shown in FIG. 19 is pressed to select image setting on the lower layer.

The address input window a6 includes, for example, a postal code field a7, an address field a8, and a recipient name field a9 so that the user can input those data. When the user touches, for example, the postal code field a7, numeric keys appear, and the user can input postal codes in the postal code field a7 using the numeric keys. Similarly, when the user touches the address field a8, numeric keys and character keys, such as kana keys (Japanese character keys) or alphabet keys, appear, and the user can input addresses in the address field a8 using those character input keys. Data can be input in a similar way in the recipient name field a9. When the recipient data is thus input, the system asks whether to register it. If the data is registered, for example, when the user inputs data in one of those fields, the system inputs corresponding data in other fields automatically.

Figure 22:
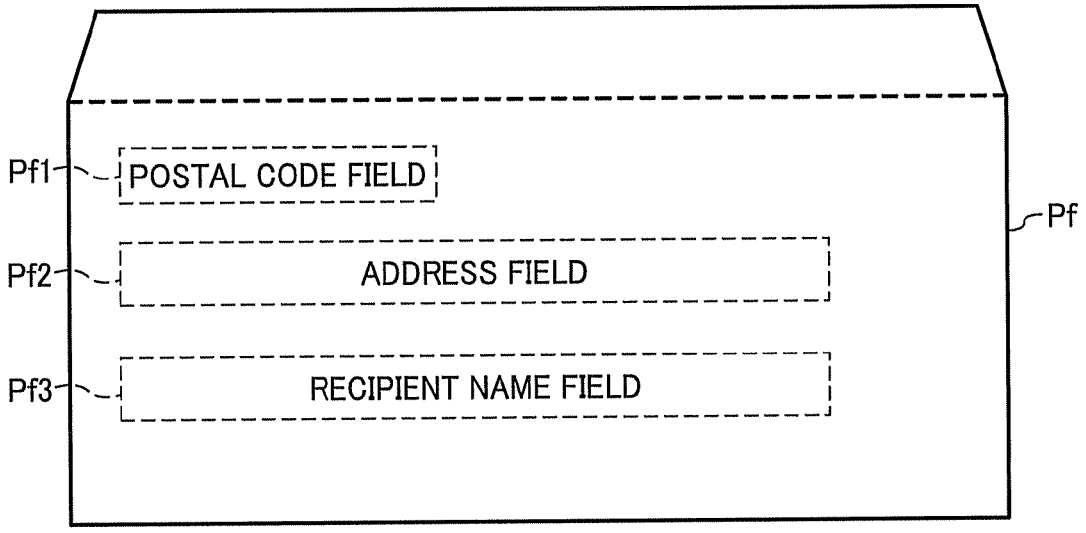
FIG. 22 illustrates a recipient data print area on envelopes.

According to the input data, postal code, address, and recipient name are printed in respective fields Pf1, Pf2, and Pf3 shown in FIG. 22.

It is to be noted that the above data can be registered in a memory unit of the image forming apparatus 1. The memory unit may store the input data in the order of input.

FIG. 22 illustrates recipient data print area on the envelope Pf.

The image formed on the envelope Pf in the configuration shown in the drawings is recipient data including postal code, address, and recipient name. In FIG. 22, a recipient data print area of the envelope Pf includes a postal code field Pf1, an address field Pf2, and a recipient name field Pf3. When image setting is performed relating to envelope setting, the data input is printed in the respective print fields Pf1, Pf2, and Pf3. Thus, "postal code", "address", and "recipient name" are input in image setting and printed in the respective print fields on the envelope Pf.

It is to be noted that the data to be printed may include postal codes, addresses, and names of senders, and additionally a "note" filed may be provided so that a given data can be input.

Figure 23:
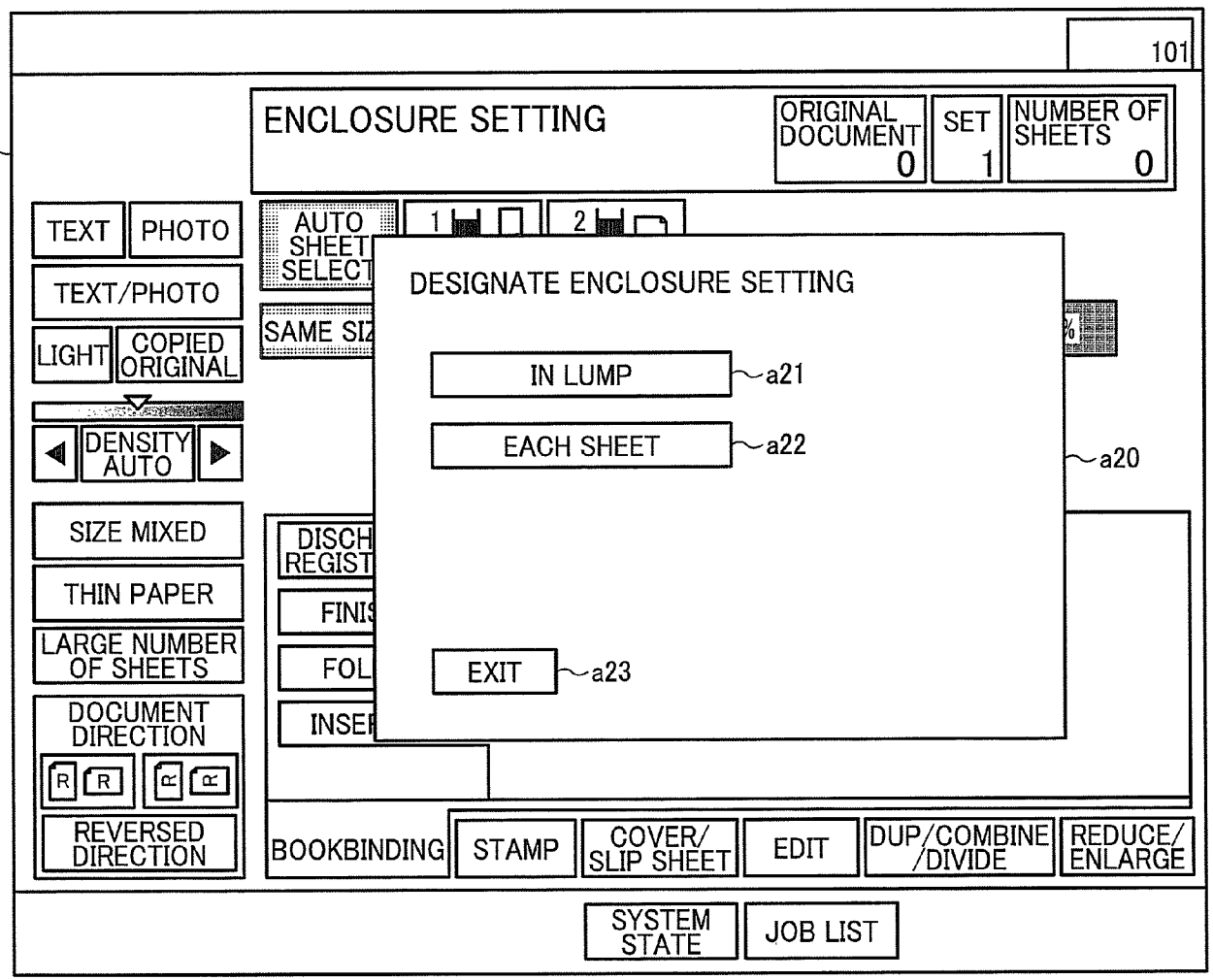
FIG. 23 illustrates an enclosure setting window, which appears when an enclosure setting button is pressed on the control panel.

FIG. 23 illustrates indications for enclosure settings on the display 1-D of the control panel 1-A.

When the ENCLOSURE SETTING button a3 is pressed on the display 1-D shown in FIG. 19, a setting display on the lower layer appears as shown in FIG. 23. On the setting display shown in FIG. 23, an enclosure setting window a20 appears together with a message "designate enclosure setting" so that the user can select whether folding setting including folding method (single-sheet folding or batch folding), folding type, and the like is made each sheet or in a lump. The enclosure setting window a20 includes an IN LUMP button a21 and an EACH SHEET button a22, and an EXIT button a23. The IN LUMP button a21 and the EACH SHEET button a22 can serve as a batch setting unit and an individual setting unit, respectively.

[Batch Setting]

Figure 24:
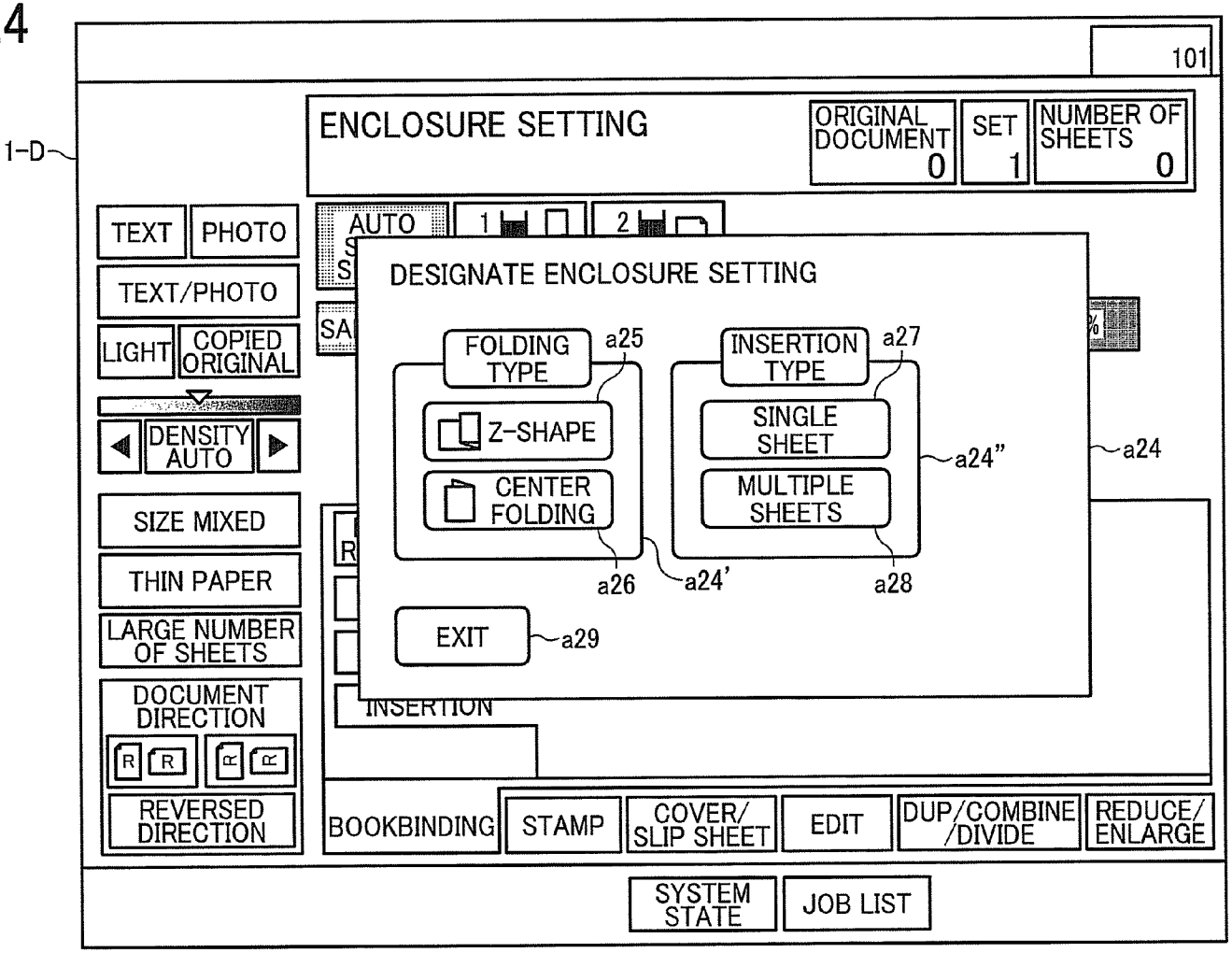
FIG. 24 illustrates indications appearing on the display of the control panel when batch setting is selected.

When the IN LUMP button a21 for batch setting is pressed, a batch setting window a24 shown in FIG. 24 appears so that processing options can be selected from folding and insertion menu for multiple sheets can be designated at a time. The folding and insertion menu includes folding type options, folding method options, and insertion method options.

On the batch setting window a24 shown in FIG. 24, a FOLDING TYPE field a24' and an INSERTION TYPE field a24" appear together with the message "designate enclosure setting". The FOLDING TYPE field a24' includes a Z-SHAPE button a25 and a CENTER FOLDING button a26. The INSERTION TYPE field a24" includes a SINGLE SHEET button a27 for selecting single-sheet folding and a MULTIPLE SHEETS button a28 for selecting batch folding. The batch setting window a24 further includes an EXIT button a29 to complete setting. Thus, folding type and folding method can be set simultaneously on the batch setting window a24.

It is to be noted that folding method (single-sheet folding or batch folding) is designated as the insertion type in the example shown in FIG. 24 because the multiple sheets folded together are inserted into the same envelope. Although not shown in FIG. 24, the folding and insertion menu further includes an option of inserting multiple sheets together into an identical envelope without folding processing.

In the configuration shown in FIG. 24, as the folding type, either folding into Z-shape or center folding can be selected using the Z-SHAPE button a25 or the CENTER FOLDING button a26 in the FOLDING TYPE FIELD a24'.

In the INSERTION TYPE FIELD a24", whether the multiple sheets are subject to single-sheet folding or batch folding can be designated using the SINGLE SHEET button a27 or the MULTIPLE SHEETS button a28.

After necessary settings are made, the user can finish the setting by pressing the EXIT button a29. Thus, setting regarding image formation on the enclosure is completed.

Figure 25:
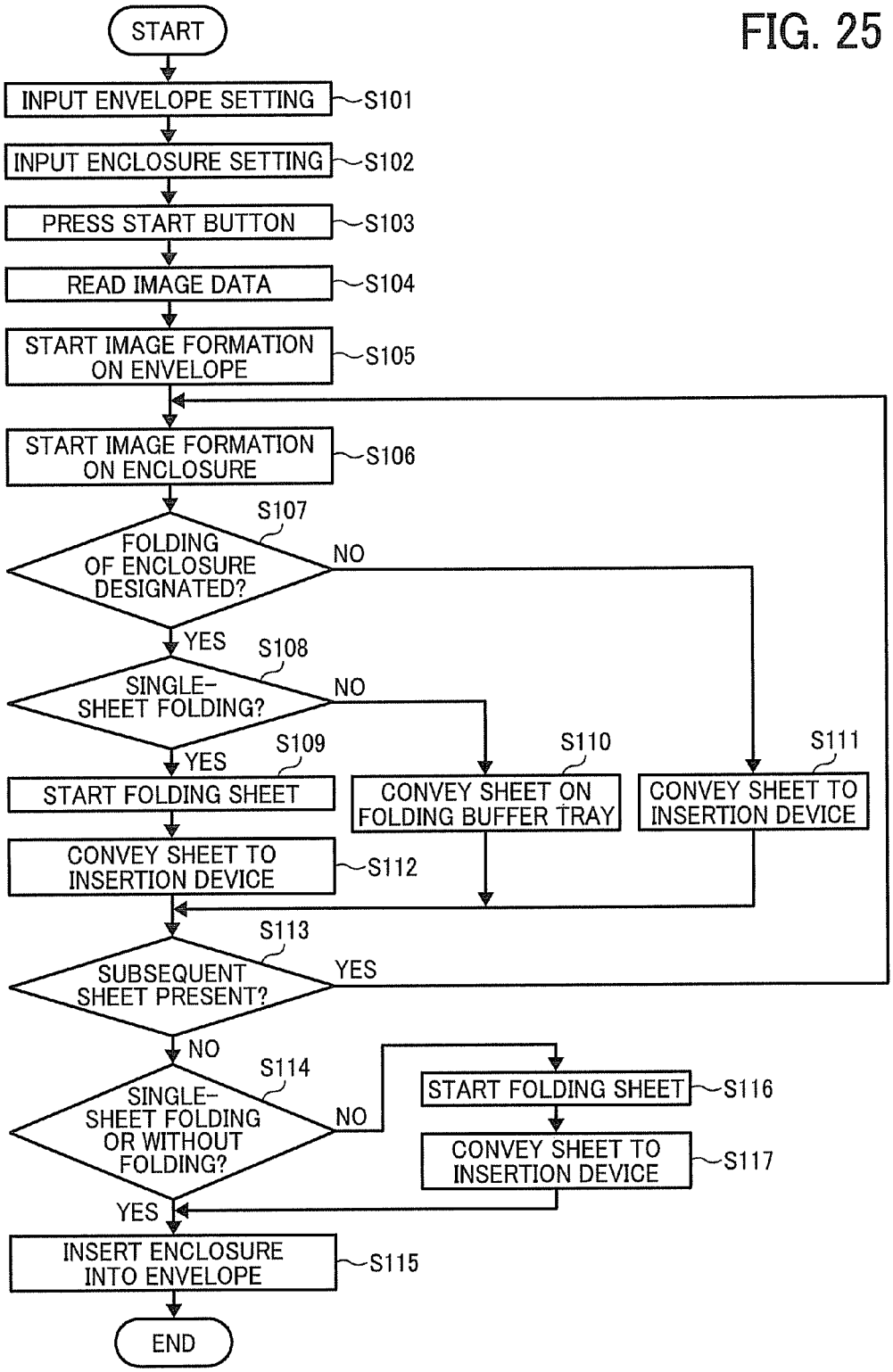
FIG. 25 is a flowchart illustrating a procedure for setting folding type and the like in batch setting.

FIG. 25 is a flowchart illustrating a procedure for setting folding type and the like in a lump.

Although this procedure is under control of the CPU 1U of the image forming apparatus 1, the CPUs 2U and 3U of the folding device 2 and the insertion device 3 control the respective parts.

In the procedure shown in FIG. 25, the envelope Pf is selected in envelope setting, and the material inserted into it is selected from the sheets P set in the sheet cassettes 1-B. Then, the combination of images (e.g., addresses) to be printed on the envelope Pf and the enclosure is designated at S101 and S102, after which the user presses the SETTING COMPLETION (or EXIT) button a5 to determine these settings. At S103, the user presses the START button d on the control panel 1-A. Then, the ADF 1-C transports the original, and an image reading unit of the image forming apparatus 1 reads image data of the original at S104. At S105, the image forming apparatus 1 starts image formation on the envelope Pf.

At S106, image formation on the sheet P (enclosure) is started. At S107, the control circuits checks whether folding of the sheet (enclosure) is designated. When the sheet is to be folded (Yes at S107), at S108 the control circuits further checks whether single-sheet folding is selected, that is, the SINGLE SHEET button a27 is pressed. In the case of single-sheet folding (Yes at S108), the sheet is folded at S109 and conveyed to the insertion device 3 at S112. At S113, the control circuit checks presence of subsequent sheets. When single-sheet folding is selected (Yes at S108), subsequent sheets are not present (No at S113), and the process proceeds to the step S114. Since single-sheet folding is confirmed at S108 (Yes at S114), at S115 the folded sheet is inserted into the envelope Pf.

By contrast, if single-sheet folding is not selected (No at S108), at S110 the sheet P is conveyed to the second conveyance path 217 serving as a folding buffer tray of the folding device 2. The folding buffer tray is used to stack multiple sheets to be folded together. Subsequently, at S113, the control circuit checks presence of subsequent sheets. If there are unprocessed sheets to be folded together (Yes at S113), the process returns to step S106 to start image formation on the subsequent sheet. Thus, the loop of operation is repeated. While this operation is repeated, multiple sheets P are stacked on the folding buffer tray.

After all of the sheets inserted together are stacked on the folding buffer tray (No at S113), at S114, the control circuit checks whether single-sheet folding is selected or the sheets are inserted without being folded. In the case of single-sheet folding or the sheet is inserted without being folded (Yes at S114), the insertion device 3 inserts the sheet into the envelope at S115. If multiple sheets are folded together (No at S114), at S116 the folding device 2 folds the sheets stacked on the folding buffer tray, after which the sheets are conveyed to the insertion device 3 at S117. At S115, the insertion device 3 inserts the sheets into the envelope.

By contrast, if the sheet is not folded but be inserted (No at S107), at S111 the sheet is conveyed to the insertion device 3. Specifically, the sheet is stored on the temporary storage tray 15, serving as an insertion processing unit, until insertion is started. Subsequently, if there are sheets remaining (Yes at S113), the process returns to step S106 to start image formation on the subsequent sheet. While the loop of operation is repeated, multiple sheets are stacked in the insertion processing unit.

After all of the sheets inserted together are stacked on the folding buffer tray (No at S113), at S114, the control circuit checks whether single-sheet folding is selected or folding is not designated. In this case, folding is not designated, and at S115 the sheets are inserted into the envelope as is.

[Individual Setting]

Figure 26:
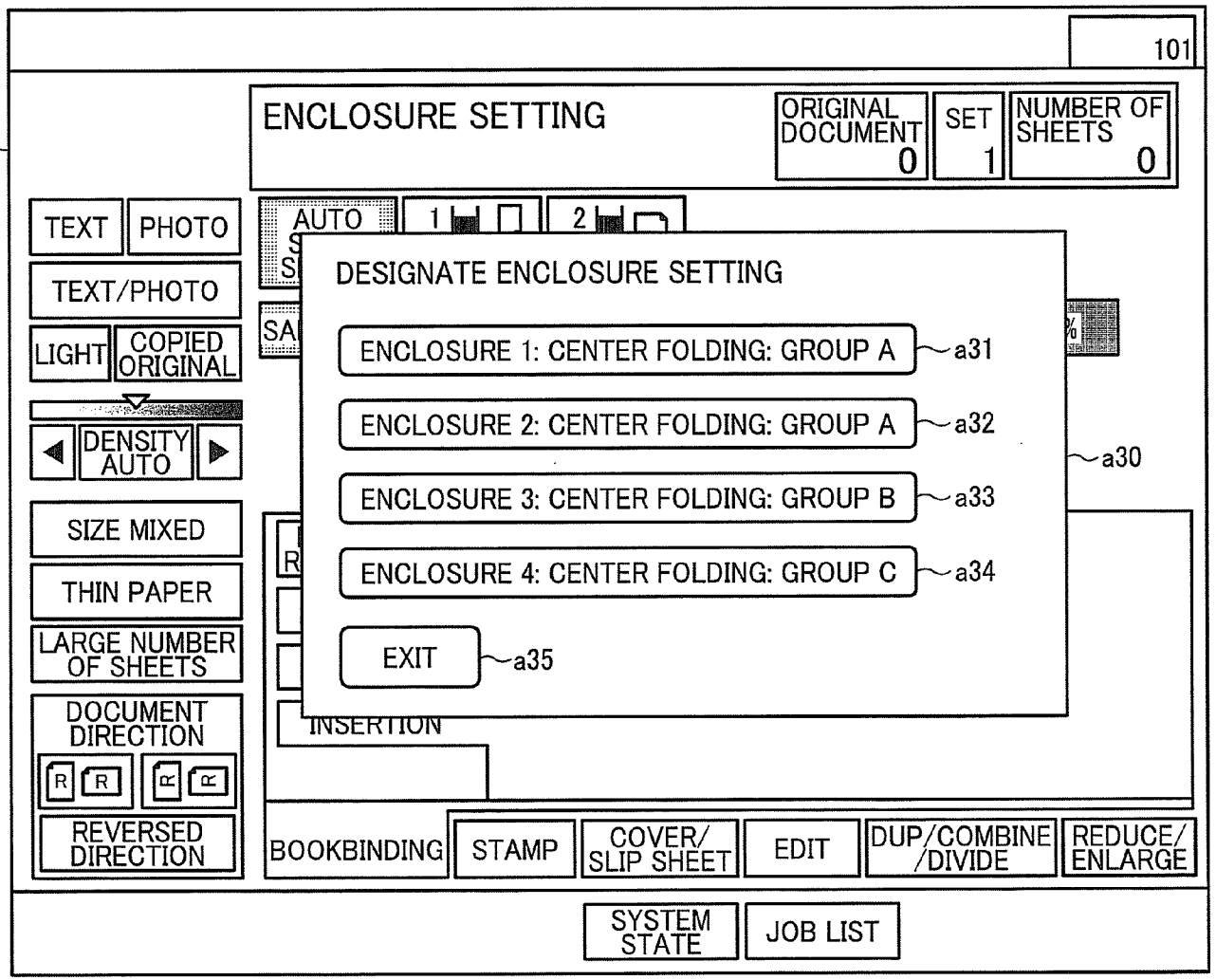
FIG. 26 illustrates indications appearing on the display of the control panel when individual setting is selected.

When the EACH SHEET button a22 is pressed on the display shown in FIG. 23, an individual setting input window a30 shown in FIG. 26 appears.

In the individual setting input window a30, folding type and insertion type can be designated for each sheet. On the individual setting input window a30, selection buttons a31, a32, a33, and a34 for selecting enclosures 1 through 4 and an EXIT button a35 appear together with the message "designate enclosure setting". In the configuration shown in FIG. 26, by pressing the selection buttons a31 through a34, folding type and insertion group of the enclosure 1 through 4 can be designated, respectively. In the configuration shown in FIG. 26, enclosures 1 through 4 are designated as follows:

Enclosure 1, Center folding, Group A,
Enclosure 2, Center folding, Group A,
Enclosure 3, Center folding, Group B, and
Enclosure 4, Center folding, Group C.

The enclosures 1 and 2, which are in the same group, group A, are folded together. The enclosure 3, which is the only enclosure in group B, is subject to single-sheet folding. Similarly, the enclosure 4 in group C is subject to single-sheet folding. The enclosures are thus grouped, and the enclosures in the same group are folded together. Accordingly, the folding option, either single-sheet folding or batch folding, can be selected. It is to be noted that, in the example shown in FIG. 26, the enclosures 1 through 4 represent first, second, third, and fourth sheets, and four sheets are subject to center folding and insertion processing.

Figure 27:
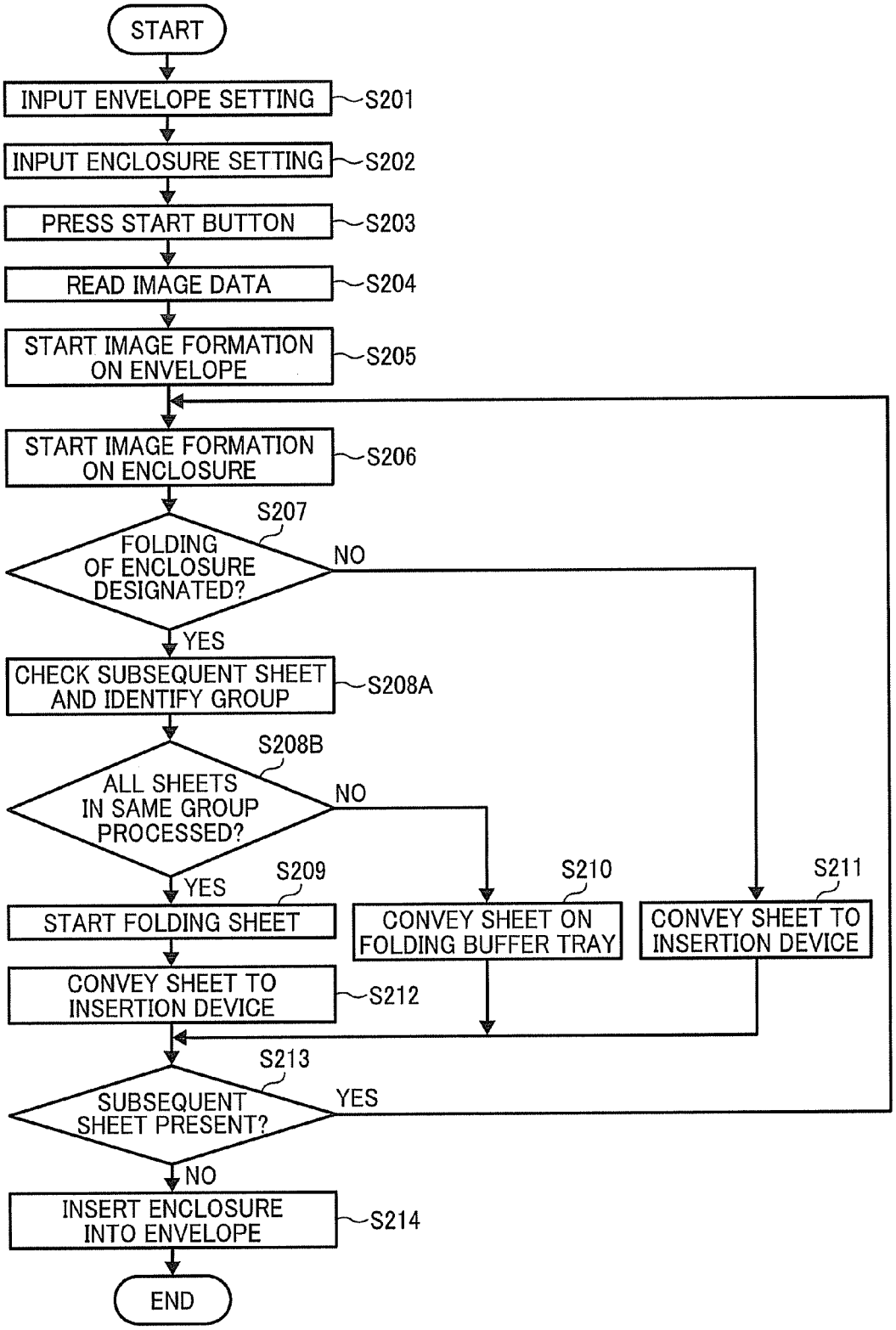
FIG. 27 is a flowchart illustrating a procedure for setting folding type and the like for each sheet.

FIG. 27 is a flowchart illustrating a procedure for designating folding type and the like for each sheet.

Operations performed from steps S201 through S207 are similar to those performed from steps S101 through S107 shown in FIG. 25, and thus descriptions thereof are omitted. When folding processing is designated (Yes at S207), at S208A the control circuit checks the insertion group of the subsequent sheet. When image formation on all the sheets in the same insertion group is completed (Yes at S208B), the sheets are folded at S209. In other words, when there are no unprocessed sheets of the same insertion group, or the subsequent sheet is in a different insertion group, the sheets are then folded. Subsequently, at S212, the sheet is conveyed to the insertion processing unit. If any unprocessed sheet is present (No at S213), at S215 the sheets are inserted into the envelope.

By contrast, if there are unprocessed sheets in the same group remaining (No at S208B), the current sheet is conveyed to the second conveyance path 217 (folding buffer tray) at S210. Further, the presence of subsequent sheet is checked at S213. If there is a subsequent sheet, the process returns to step S206. Then, the loop of forming an image on the subsequent sheet and storing the sheet on the folding buffer tray is repeated.

If there is no more unprocessed sheet in the same group (Yes at S208B), the sheet is not stored in the folding buffer tray but is folded at S209. However, if sheets of the same group are stored in the folding buffer tray, those sheets are folded together with the current sheet at S209. At S212, the folded sheets are conveyed to the insertion device 3, and, at S213, presence of subsequent sheets is checked. The sheets are inserted into the envelope at S214.

By contrast, if the sheet is not folded but is inserted (No at S207), at S211 the sheet is conveyed to the insertion processing unit of the insertion device 3. The sheet is kept in the temporary storage tray 15 until insertion is started. Subsequently, if there are sheets remaining (Yes at S213), the process returns to step S206 to start image formation on the subsequent sheet. Thus, the loop of operation is repeated. While the loop of operation is repeated, multiple sheets are stacked in the insertion processing unit. After all sheets are stacked in the insertion processing unit at S211 (No at S213), at S214 the sheets are inserted into the envelope Pf.

It is to be noted that, although the image scanned from the original conveyed by the ADF 1-C is input to the insertion system in the procedure shown in FIGS. 25 and 27, alternatively, printer drivers of computers may be used to input images.

Figure 28:
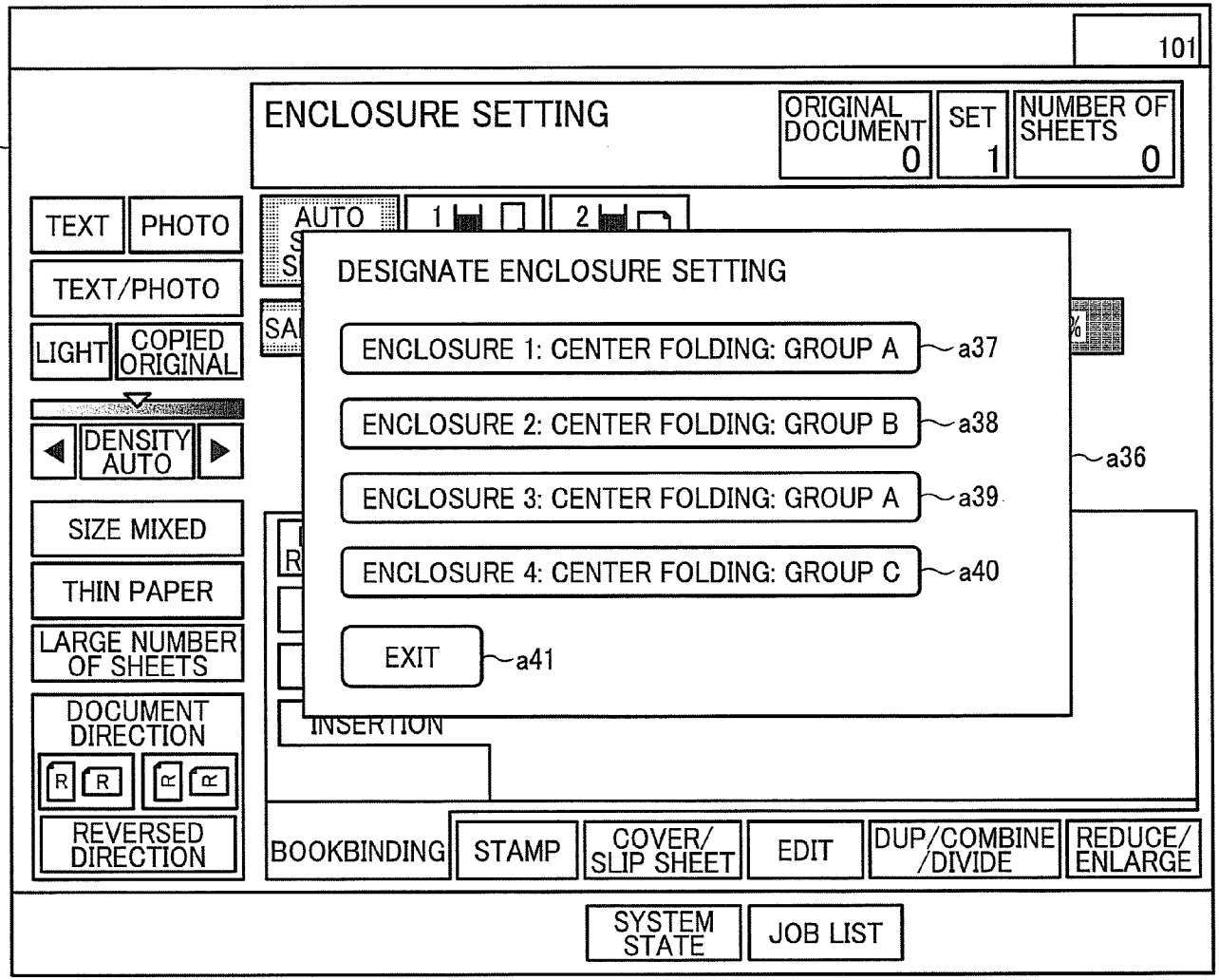
FIG. 28 illustrates an individual setting input window.

FIG. 28 illustrates another individual setting input window.

When the EACH SHEET button a22 is pressed on the display shown in FIG. 23, an individual setting input window a36 shown in FIG. 28 appears.

Figure 29:
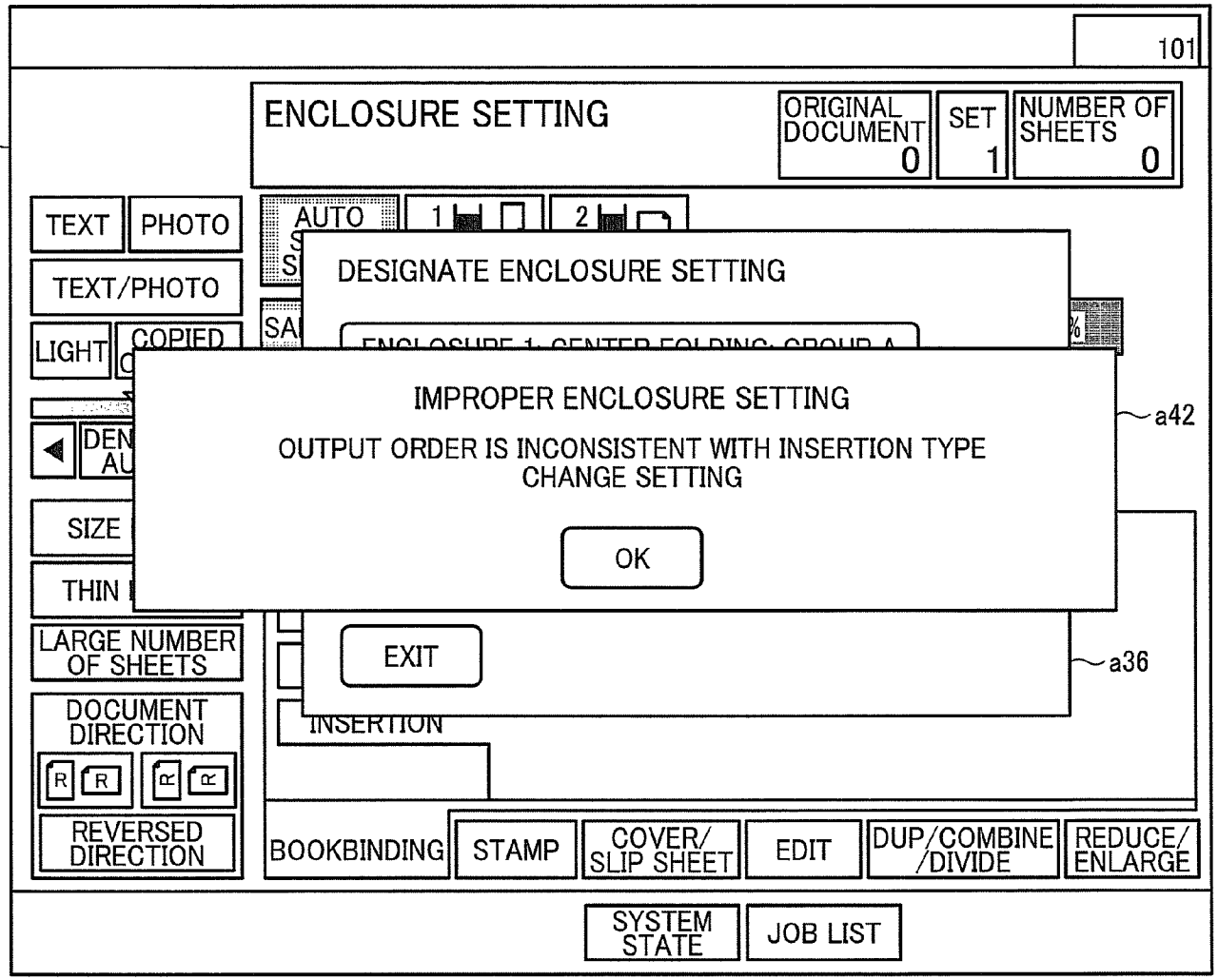
FIG. 29 illustrates an error report window to report to the user enclosure setting is improper.

In the individual setting input window a36, folding type and insertion type can be designated for each sheet similarly to the individual setting input window a30. On the individual setting input window a36, selection buttons a37, a38, a39, and a40 for selecting enclosures 1 through 4 and an EXIT button a41 appear together with the message "designate enclosure setting". In the configuration shown in FIG. 28, by pressing the selection buttons a37 through a41, folding type and insertion group of the enclosure 1 through 4 can be designated, respectively. In the configuration shown in FIG. 28, enclosures 1 through 4 are designated as follows:

Enclosure 1, Center folding, Group A,
Enclosure 2, Center folding, Group B,
Enclosure 3, Center folding, Group A, and
Enclosure 4, Center folding, Group C The enclosures 1 and 3 are in the same group, group A. The enclosures 2 and 4 are respectively groups B and C. Although the enclosures 1 and 3 are in the same group, folding them together is not feasible if the enclosure B in the different group is interposed between them. Therefore, in this configuration, after the EXIT button a41 is pressed on the individual setting input window a36 shown in FIG. 28, the CPU 1U of the image forming apparatus 1 checks the order of image formation on the multiple sheets and insertion type of those sheets. At that time, recognizing that folding processing is not feasible in the designated folding option, the control circuit displays an error report window a42 as shown in FIG. 29 to report to the user that the designated folding and insertion options are improper. More specifically, messages "output order is inconsistent with insertion type" and "change setting" are displayed, and the setting in FIG. 28 is prohibited.

Figure 30:
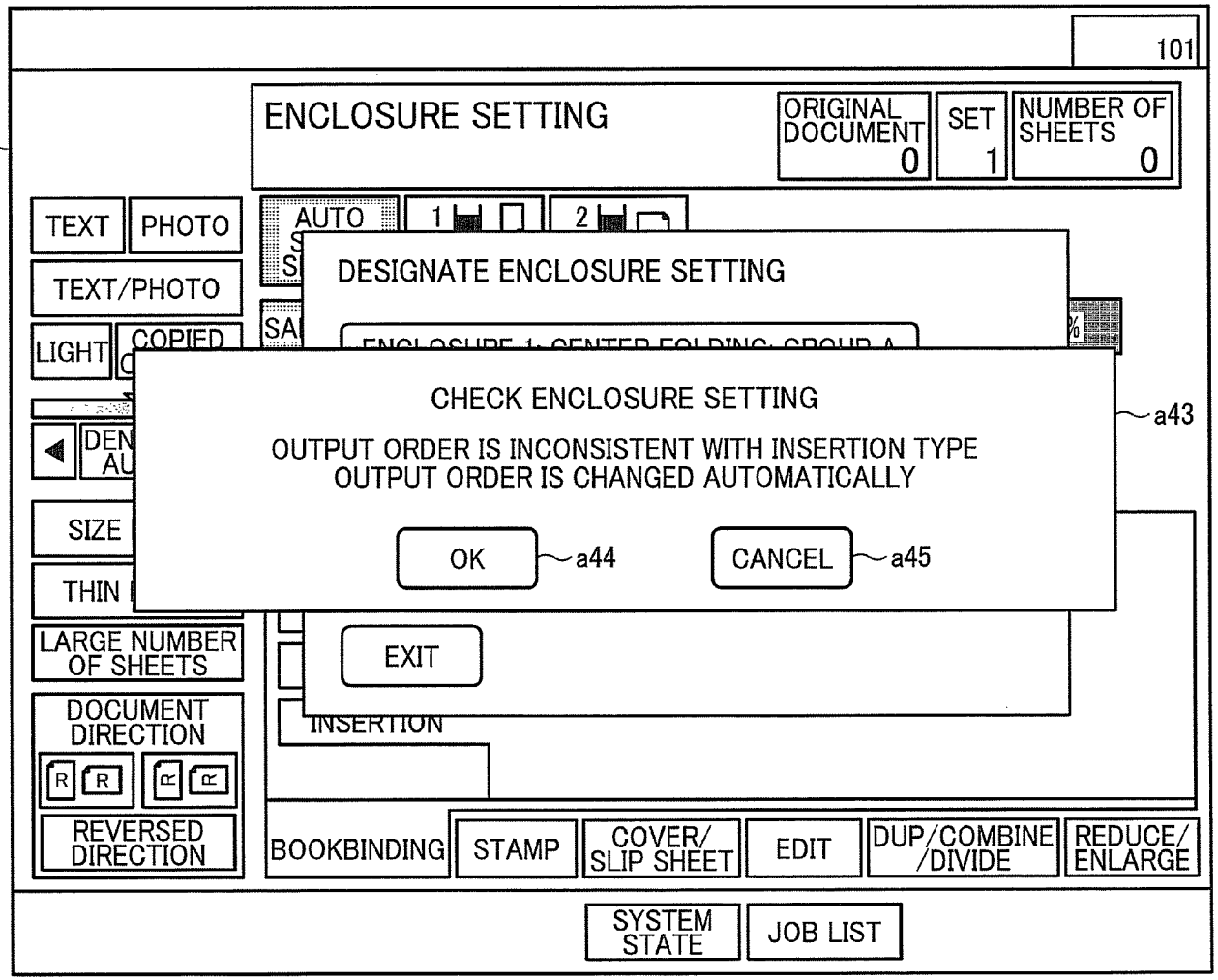
FIG. 30 illustrates a confirmation window to prompt the user to permit changes in output order or cancel the insertion setting.

Alternatively, output order may be changed automatically, and a confirmation window a43 shown in FIG. 30 may be displayed to prompt the user to permit the changed output order or cancel the designated folding and insertion options. When the user presses an OK button a44 in the confirmation window a43, the changed output order is permitted. When a cancel button a45 is pressed, the changed output order is not permitted.

That is, when the CPU 1U of the image forming apparatus 1 deems folding processing and insertion unfeasible after comparing the output order with the designated folding and insertion options, the CPU 1U suggests changing the output order to make the designated folding setting executable. Then, indication shown in FIG. 30 is displayed, and, when the OK button a44 is pressed on the confirmation window a43 shown in FIG. 30, the output order is changed.

For example, the enclosures are output in the order of enclosure 1, enclosure 3, enclosure 2, and enclosure 4. With this operation, the order of insertion can be similar to that shown in FIG. 26, and the sheets can be processed as designated.

Figure 31:
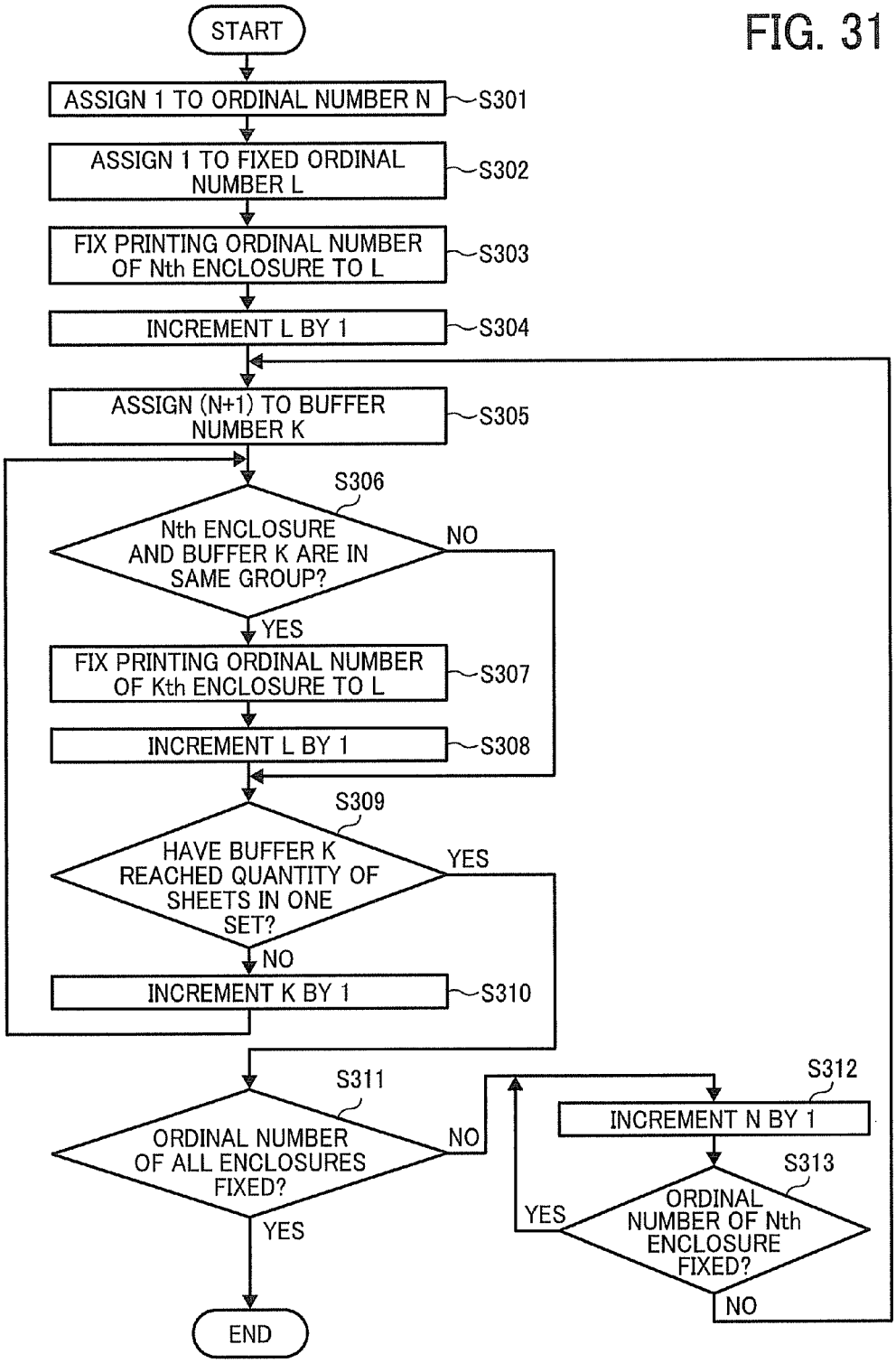
FIG. 31 is a flowchart illustrating a procedure for changing the output order.

FIG. 31 is a flowchart illustrating a procedure for changing the order of image formation (i.e., output order).

At S301, "1" is assigned to an ordinal number N of the designated enclosure. It is to be noted that "ordinal number" used here means "1" through "4" assigned to the respective enclosures shown in FIG. 28. At S302, "1" is assigned to a fixed ordinal number L of image formation. It is to be noted that "fixed ordinal number L" used here means "1" through "4" assigned to the respective enclosures shown in FIG. 26. Thus, the printing ordinal number of the Nth enclosure is set to L. In other words, the ordinal number of printing of enclosure 1 is set to "L" (L=1).

At S304, the fixed printing ordinal number L is incremented by one. At S305 "N+1" is assigned to a buffer number K that serves as a buffer when a different group is searched. At that time, "1+1", that is, "2", is assigned to the buffer number K. At S306, the control circuit checks whether the Nth enclosure (e.g., enclosure 1) and the buffer number K assigned at S305 (enclosure 2) are in the same group. In this example, the enclosures 1 and 2 are in groups A and B, respectively, that is, in different groups (No at S306), and the control circuit checks whether the buffer number K reaches the total number of enclosures at S309. At that time, the buffer number K is "2", and the total number of enclosures is "4" (No at S309). Then, at S310 the buffer number K is incremented.

The buffer number K thus incremented becomes "3", and the process returns to step S306. At S306 the control circuit checks whether the Nth enclosure (e.g., enclosure 1) and the buffer number K (3=enclosure 3) are in the same group. The enclosures 1 and 3 are in the same group (Yes at S306). When the Nth enclosure and the buffer number K are in the same group, at S307 the fixed ordinal number of printing L of the Kth enclosure (=enclosure 3) is fixed at "2". At S308 the fixed ordinal number of printing L is incremented by one, and at S309 the control circuit checks the number of enclosures. At that time, the buffer number K is "3" (No at S309), and at S310 the buffer number K is incremented to "4", after which the process returns to step S306. Then, whether the Nth enclosure (e.g., enclosure 1) and the buffer number K (4=enclosure 4) are in the same group is checked.

The determination at S306 is "No" and, at S309, the control circuit checks whether the buffer number K reaches the quantity of enclosures. The current buffer number K is "4" (Yes at S309), and at S311 the control circuit checks whether printing ordinal numbers of all enclosures are fixed. At that time, the ordinal numbers of printing of only two sheets are fixed (No at S311), at S312 the ordinal number N is incremented (N+1=2). At S313, whether the printing ordinal number of the enclosure 2 is fixed is checked. When the printing ordinal number of the enclosure 2 is not yet fixed (No at S313), and the process returns to S305. At S305, "3" is assigned to the buffer number K, and the step S306 and subsequent steps are repeated until the output order of the enclosure 4 is fixed. Thus, the output order of enclosures is fixed.

It is to be noted that, although the above-described designation and selection are made via the control panel 1-A, the CPU 2U of the folding device 2 controls operations relating to folding, the CPU 3 U controls operations relating to insertion, and the CPU 1U controls processing and setting relating to the entire insertion system. The CPU 2U and CPU 3U are under control of the CPU 1U of the image forming apparatus 1. Needless to say, the control panel 1-A may be provided to any of the devices, other than the image forming apparatus 1, included in the insertion system or image formation system.

As described above, the present embodiment can attain the following effects.

The system according to the above-described embodiment includes the folding device 2 to fold a single sheet or multiple sheets together at a time, and the insertion device 3 to insert the single sheet or multiple sheets into an envelope. When multiple sheets are subject to folding and insertion processing, whether a single sheet is folded at a time (i.e., single-sheet folding) or multiple sheets are folded together at a time (batch folding) can be designated. Further, whether such designation is made for each sheet (i.e., individual setting) or in a lump (i.e., batch setting) can be selected using the enclosure setting window a20. The enclosure setting window a20 includes the IN LUMP button a21 to designate options relating to folding and insertion of multiple sheets at a time and the EACH SHEET button a22 to designate the options relating to folding and insertion for each sheet. Thus, a variety of insertion processing can be made efficiently.

Additionally, when the multiple sheets are to be folded and inserted into an envelope or respective envelopes, either the single-sheet folding or the batch folding can be designated for each sheet by pressing the EACH SHEET button a22 on the enclosure setting window a20. Thus, a variety of insertion processing can be designated individually.

The user can use the IN LUMP button a21 and the EACH SHEET button a22 to select folding and insertion options either individually or in batch. Therefore, the system is user friendly.

When the batch setting is selected, the folding method (either the single-sheet folding or batch folding) and folding type can be selected on the batch setting window a24.

Further, either the batch setting or the individual setting can be selected for each set of sheets inserted into an identical envelope.

When the batch folding to fold multiple sheets at a time is designated in the batch setting, the order of image formation on the multiple sheets is compared with the ordinal number of the sheets in the batch folding, and the order of image formation can be changed to enable the batch folding.

When the order of image formation is changed to enable the batch folding, it can be reported to the user.

Additionally, the user can either confirm or cancel the changed order of image formation. Therefore, the folding and insertion processing can meet the needs and intention of the user.

Additionally, the image forming apparatus 1, the folding device 2, and the insertion device 3 are connected inline. Accordingly, image formation on the enclosure, folding the enclosure, and insertion of the enclosure can be performed automatically, thus increasing the production efficiency.

It is to be noted that, even for a set of sheets inserted into an identical envelope, either the single-sheet folding or the batch folding can be selected for each sheet. Moreover, whether sheets inserted into different envelopes are stacked and folded together can be selected.

In the embodiment described above, the CPU 2U and the control panel 1-A can serve as the batch setting unit. The control panel 1-A can also serve as the selection unit, the folding method selection unit, and an output order changer.

Additionally, the folding and insertion menu may further include insertion options, and either a sheet folded in a single folding operation is inserted into an envelope or a set of sheets folded in different folding operations is inserted into an identical envelope is selected as the insertion option. Thus, by designating options regarding folding and insertion processing for multiple sheets at a time, a variety of folding and insertion processing can be designated efficiently.

Numerous additional modifications and variations are possible in light of the above teachings. It is therefore to be understood that, within the scope of the appended claims, the disclosure of this patent specification may be practiced otherwise than as specifically described herein.

What is claimed is:

1. An insertion system comprising:

a folding device to perform either single-sheet folding to fold a single sheet at a time or batch folding to fold multiple sheets together at a time;

an insertion device to insert into an envelope the sheet folded by the folding device;

a batch setting unit to designate either the single-sheet folding or the batch folding from a folding and insertion menu for multiple sheets at a time when the multiple sheets are processed by the folding device and the insertion device;

an individual setting unit to designate either the single-sheet folding or the batch folding from the folding and insertion menu for each of the multiple sheets processed by the folding device and the insertion device; and a selection unit via which a user selects either the batch setting unit or the individual setting unit.

2. The insertion system according to claim 1, wherein the folding and insertion menu further comprises folding type options and folding method options.

3. The insertion system according to claim 2, further comprising a folding type selection unit to select one of the folding type options; and a folding method selection unit to select either the single-sheet folding or the batch folding.

4. The insertion system according to claim 1, wherein either the batch setting unit or the individual setting unit is selected for each set of sheets inserted into a single envelope.

5. The insertion system according to claim 1, further comprising an image forming apparatus to form an image on at least one of the envelope and the sheet inserted into the envelope.

6. The insertion system according to claim 5, further comprising a controller to control image formation, folding operation, and insertion operation; and an output order changer to change order of image formation on the multiple sheets, wherein, when the batch setting unit designates the batch folding to fold multiple sheets at a time, the controller compares the order of image formation on the multiple sheets with order of batch folding, and when the order of image formation is inconsistent with the order of batch folding, the output order changer changes the order of image formation to enable the batch folding.

7. The insertion system according to claim 6, further comprising a display to display the selection unit and a message to the user, wherein the display indicates that the output order changer changes the order of image formation when the order of image formation is inconsistent with the order of batch folding.

8. The insertion system according to claim 7, further comprising a change confirmation unit to confirm or cancel changes in the order of image formation made by the output order changer when the display indicates that the output order changer changes the order of image formation.

9. An insertion method comprising:

selecting whether a processing option of multiple sheets processed by a folding device and an insertion device is designated at a time or for each of the multiple sheets;

designating, via a batch setting unit, either single-sheet folding to fold a single sheet at a time or batch folding from a folding and insertion menu to fold multiple sheets together at a time according to selection made at the selecting step as a folding method;

designating, via an individual setting unit, either the single-sheet folding to fold the single sheet at a time or the batch folding from the folding and insertion menu to fold multiple sheets together at a time;

selecting either the batch setting unit or the individual setting unit;

folding the multiple sheets according to a designated folding method; and inserting into either a single envelope or respective envelopes the folded sheets.

10. An insertion system comprising:

a folding device to perform either single-sheet folding to fold a single sheet at a time or batch folding to fold multiple sheets together at a time;

an insertion device to insert into an envelope the sheet folded by the folding device;

a batch setting unit to designate either the single-sheet folding or the batch folding from a folding and insertion menu for multiple sheets at a time when the multiple sheets are processed by the folding device and the insertion device; and an individual setting unit to designate either the single-sheet folding or the batch folding from the folding and insertion menu for each of the multiple sheets processed by the folding device and the insertion device, wherein either the batch setting unit or the individual setting unit is selected for each set of sheets inserted into a single envelope.

* * * * *